US006293655B1

(12) United States Patent
Imanaka et al.

(10) Patent No.: US 6,293,655 B1
(45) Date of Patent: Sep. 25, 2001

(54) LIQUID EJECTING HEAD, HEAD CARTRIDGE AND LIQUID EJECTING APPARATUS

(75) Inventors: Yoshiyuki Imanaka, Kawasaki; Masahiko Ogawa, Hino; Masami Ikeda, Tokyo; Ichiro Saito, Yokohama; Hiroyuki Ishinaga, Tokyo; Tomoyuki Hiroki, Zama; Teruo Ozaki, Yokohama; Masahiko Kubota, Tokyo, all of (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/205,727

(22) Filed: Dec. 4, 1998

(30) Foreign Application Priority Data

Dec. 5, 1997 (JP) ..... 9-336053
Nov. 18, 1998 (JP) ..... 10-328430

(51) Int. Cl.[7] ..... B41J 2/05
(52) U.S. Cl. ..... 347/65; 347/58
(58) Field of Search ..... 357/59, 58, 57, 357/56, 50, 44, 20, 14, 5, 63, 65

(56) References Cited

U.S. PATENT DOCUMENTS

| | | | | |
|---|---|---|---|---|
| 4,723,129 | | 2/1988 | Endo et al. | 346/1.1 |
| 4,881,318 | | 11/1989 | Komuro et al. | 29/827 |
| 5,479,197 | | 12/1995 | Fujikawa et al. | 347/63 |
| 5,504,507 | * | 4/1996 | Watrobski et al. | 347/19 |
| 5,580,468 | | 12/1996 | Fujikawa et al. | 216/27 |
| 5,602,576 | | 2/1997 | Murooka et al. | 347/59 |
| 5,625,384 | | 4/1997 | Numata et al. | 347/23 |
| 5,701,147 | * | 12/1997 | Nozawa | 347/58 |
| 5,731,828 | | 3/1998 | Ishinaga et al. | 347/62 |
| 5,821,962 | * | 10/1998 | Kudo et al. | 347/65 |
| 5,841,448 | | 11/1998 | Moriyama et al. | 347/19 |
| 5,880,762 | | 3/1999 | Ishinaga et al. | 347/62 |

FOREIGN PATENT DOCUMENTS

| | | |
|---|---|---|
| 0 585 890 | 3/1994 | (EP) . |
| 0 764 532 | 3/1997 | (EP) . |
| 0 767 060 | 4/1997 | (EP) . |
| 0 768 180 | 4/1997 | (EP) . |

* cited by examiner

*Primary Examiner*—John Barlow
*Assistant Examiner*—Blaise Mouttet
(74) *Attorney, Agent, or Firm*—Fitzpatrick, Cella, Harper & Scinto

(57) ABSTRACT

A liquid ejection head having a plurality of ejection outlets for ejecting liquid; a first substrate and a second substrate for constituting a plurality of liquid flow paths in fluid communication with the ejection outlets, respectively when combined with each other; a plurality of energy conversion elements disposed in the liquid flow paths, respectively to convert electrical energy to ejection energy for the liquid in the liquid flow paths; a plurality of elements or electric circuits having different functions for controlling driving conditions of the energy conversion elements; wherein the elements and electric circuits are provided either on the first substrate or the second substrate, depending on their functions.

30 Claims, 20 Drawing Sheets

LIQUID EJECTING HEAD, HEAD CARTRIDGE AND LIQUID EJECTING APPARATUS

FIELD OF THE INVENTION AND RELATED ART

The present invention relates to a liquid ejecting head for ejecting a desired liquid using generation of a bubble created by application of thermal energy to the liquid, a head cartridge and a liquid ejecting apparatus which use the liquid ejecting head.

The present invention is applicable to various apparatus such as a printer, a copying machine, a facsimile machine having a communication system, a word processor having a printer portion, or a printing apparatus, for industrial use, combined with various processing devices, which effect recording on recording materials such as paper, thread, fiber, textile, leather, metal, plastic resin material, glass, wood, ceramic material or the like.

Here, "recording" means recording of image having any sense such as letters, figures or the like, and recording of patterns not having particular sense.

An ink jet recording method or so-called bubble jet recording method is known wherein state change resulting in abrupt volume change is caused in the ink (generation of a bubble) by application of energy such as heat to the ink, and by the force provided by the state change, the ink is ejected from an ejection outlet, and is deposited on the recording material. A recording device using the bubble jet recording method generally comprises an ejection outlet for ejecting ink, an ink flow path in fluid communication with the ejection outlet, and an electrothermal transducer, as energy generating means, for ejecting the ink in the ink flow path, as disclosed in U.S. Pat. No. 4,723,129, for example.

Such a recording method is capable of printing high quality image at high speed and with low noise; the printing or recording head using the recording method, the ejection outlets for ejecting the ink can be arranged at high density, and therefore, high resolution image and particularly color image can be easily printed with small size machine. For this reason, the bubble jet recording method is recently used widely for printers, copying machines, facsimile machine machines or other office equipment, and even for industrial systems such as textile printing apparatus or the like.

The electrothermal transducer for generating energy for ejecting the ink can be manufactured through a semiconductor manufacturing process. Therefore, a conventional head using the bubble jet technique, comprises an element substrate (silicon substrate), electrothermal transducer formed thereon, and a groove for forming an ink flow path is formed thereon, and a top plate of resin material such as polysulfone or the like or glass or the like is combined thereon.

Utilizing the fact that element substrate is a silicon substrate, in addition to the electrothermal transducers, a driver for driving the electrothermal transducers, and a temperature sensor used to control the electrothermal transducers in accordance with the temperature of the head and a drive control portion or the like may be formed on the element substrate. FIG. 20, shows an example of such a structure of the element substrate. In FIG. 20, the element substrate 1001 is provided with heater array 1002 having a plurality of parallel electrothermal transducers for applying thermal energy for ink ejection, a driver circuit 1003 for driving the electrothermal transducers, image data transfer circuit 1004 for parallel transfer of the image data inputted serially from outside to a driver circuit 1003, and an input contact 1007 for inputting the image data and various signals or the like from outside The element substrate 1001 is provided with a temperature sensor for sensing a temperature of the element substrate 1001, a resistance sensor for sensing a resistance value of the electrothermal transducers, or another sensor 1006, and a drive control portion 1005 for driving the sensor 1006 and for controlling a width of the driving pulse for the electrothermal transducers in accordance with an output from the sensor 1006. A head having the driver, the temperature sensor and the drive control portion on the element substrate has been put in practical use, with high reliability of the recording head and small size.

However, recently, a higher image quality is demanded.

As a result of inventors investigations, the following points to be improved have been found, if the density of the ejection outlets and therefore the electrothermal transducers is increased in an attempt to improve the image quality, and the electrothermal transducers are further precisely controlled.

If the circuits for controlling the electrothermal transducers are all formed on the element substrate, the size of the element substrate is bulky with the result of bulky head.

When the ejection outlets are arranged at a high density such as 600 dpi or 1200 dpi or higher, precise alignment is required between the electrothermal transducers and ink flow paths, and the difference in the thermal-expansion between the element substrate and the top plate resulting from the heat during the driving of the electrothermal transducers, is not negligible.

In the case of a head capable of ejecting fine droplets (as a result of a high density arrangement of the ejection outlets, for example), if the heater is actuated when the ink is out, there is a liability that influence of the physical damage such as the surface damage of the heater to the ejection property is more significant than a conventional head ejecting larger droplets.

SUMMARY OF THE INVENTION

Accordingly, it is a principal object of the present invention to provide a liquid ejecting head, head cartridge and a recording device using the same which is small despite addition of various functions for controlling ejection of the liquid.

It is another object of the present invention to provide a liquid ejecting head wherein positional deviation due to the difference in the thermal-expansion between the element substrate and the top plate can be prevented.

It is a further object of the present invention to provide a liquid ejecting head wherein an ink detecting mechanism is provided to prevent the damage of the heater.

According to an aspect of the present invention, there is provided a liquid ejection head comprising a plurality of ejection outlets for ejecting liquid; a first substrate and a second substrate for constituting a plurality of liquid flow paths in fluid communication with said ejection outlets, respectively when combined with each other; a plurality of energy conversion elements disposed in said liquid flow paths, respectively to convert electrical energy to ejection energy for the liquid in said liquid flow paths; a plurality of elements or electric circuits having different functions for controlling driving conditions of said energy conversion elements; wherein said elements and electric circuits are provided either on said first substrate and said second substrate, depending on their functions.

The elements or the electric circuits are not concentrated on one of the substrates, so that liquid ejecting head is downsized.

The electrical connection with the outside are not effected by each of the function element and the electric circuit, but an outer contact for electrical connection of the element or the electric circuit with the outside is provided on either one of the first substrate and the second substrate, and the outer contact electrically connects the elements or electric circuits with outside on either one of the first substrate or second substrate, and a connection electrode for electrical connection of the elements or electric circuits on such surfaces of the first substrate and second substrate as are opposed to each other, so that they are electrically connected by combining the first substrate and the second substrate. Since the connection with the outside is concentrated on one of the substrates, further downsizing can be accomplished.

The selection may be such that such an element or electric circuit of all of the elements or electric circuits as are electrically connected to said energy conversion elements on individual or group basis, is provided on such one of the substrates as is provided with the energy conversion elements, and the other element or electric circuit is provided on the other substrate. By this, the number of electrical connections between the first substrate and the second substrate decreases so that liability of defective connection can be reduced. Such an element or electric circuit of all of the elements or electric circuits as are electrically connected to the energy conversion elements on individual or group basis, may include drivers for driving said energy conversion elements. With the use of the feature that external connection contacts are provided only on one substrate, further downsizing is accomplished.

By making the first substrate and the second substrate from silicon material, the element or the electric circuit can be manufactured through a semiconductor wafer processing technique. Because the first substrate and the second substrate are made of the same materials, the deviation therebetween due to thermal-expansion difference can be avoided. Therefore, the second object can be accomplished.

At least the second substrate may be provided with a temperature sensor, a limitation circuit for limiting or stopping driving of the heat generating resistor in accordance with an output of the temperature sensor, so that difference of the temperature propagation depending on the presence or absence of the ink in the head, and the driving of the heat generating resistor can be limited or stopped on the basis of result thereof. Thus, the third object can be accomplished. By manufacturing the temperature sensor and the limitation circuit using the semiconductor wafer processing technique, highly accurate detection of presence or absence of the ink is possible without cost increase.

The energy conversion elements generate bubbles in the liquid by application of thermal energy, and each of said liquid flow paths may be provided with a movable member disposed faced to the energy conversion element and having a free end at a downstream side with respect to liquid flow toward then ejection outlet. By doing so, the propagating direction of the pressure resulting from the generation of the bubble and the expanding direction of the bubble per se can be directed toward the downstream side by the movable member, so that ejection property such as the ejection efficiency, the ejection power or the ejection speed is improved.

In this specification, "upstream" and "downstream" is with respect to the direction of flow of the liquid toward the ejection outlet through a bubble generating region (or movable member) from the supply source of the liquid.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

Figure 1:
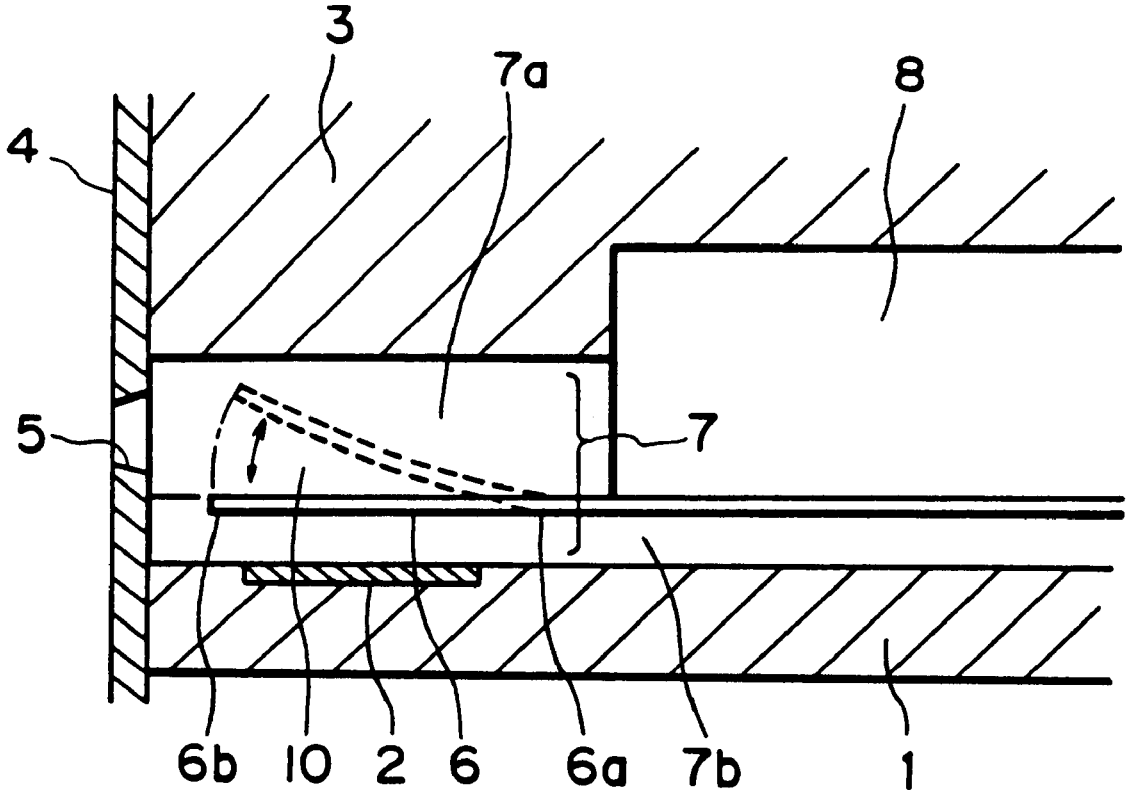
FIG. 1 is a sectional view of a liquid ejecting head according to an embodiment of the present invention, taken along a liquid flow path.

FIG. 1 is a sectional view, taken along a line parallel with a liquid flow path, of a liquid ejecting head according to an embodiment of the present invention.

As shown in FIG. 1, the liquid ejecting head comprises an element substrate 1 on which a plurality of heat generating elements 2 (only one of them is shown in FIG. 1) for applying thermal energy for generating bubbles to liquid are disposed in parallel, a top plate 3 connected to the element substrate 1, an orifice plate 4 connected to the leading edge surface of the top plate 3, and a movable member 6 placed in a liquid flow path 7 constituted by the element substrate 1 and the top plate 3.

The element substrate 1 comprises a substrate of silicon or the like, a silicon oxide film or silicon nitride film thereon for electric insulation and heat accumulation, and an electric resistance layer (heat generating element 2) and wiring patterned thereon. The electric resistance layer is supplied with a voltage through the wiring to supply the current to the electric resistance layer, so that heat generating element 2 generates heat.

The top plate 3 cooperates to constitute liquid flow paths 7 corresponding to the heat generating elements 2, respectively, and a common liquid chamber 8 for supplying the liquid to the liquid flow paths 7, and it includes integral side walls extending from the top between the heat generating elements 2. The top plate 3 is a silicon material, and is manufactured by etching the liquid passage pattern and the common liquid chamber pattern, or by overlying on the silicon substrate silicon nitride material, silicon oxide or the like through known CVD method or the like to constitute the side walls, and then etching the liquid passage portions.

The orifice plate 4 is provided with ejection outlets 5 which are formed corresponding respective liquid passages and which are in fluid communication with the common liquid chamber 8 through the liquid passages. The orifice plate 4 is of silicon material too, and is manufactured by machining a silicon substrate having ejection outlets 5 into a thickness of approx. 10–150 $\mu$m. In the present invention, the orifice plate 4 is not an inevitable element, and in place of the provision thereof, a wall of a thickness corresponding to the orifice plate 4 may be caused to remain at the end surface of the top plate 3 when the liquid flow path is formed in the top plate 3, and the ejection outlets 5 may be formed in the remaining portion.

The movable member 6 separates the liquid flow path 7 to a first liquid flow path 7*a* in fluid communication with the ejection outlet 5 and a second release path 7*b* having a heat generating element 2, and is disposed opposed to the heat generating element 2. It is in the form of a thin film cantilever of silicon material such as silicon nitride, silicon oxide or the like.

The movable member 6 has a fulcrum 6*a* at an upstream with respect to a major liquid flow from the common liquid chamber 8 to the ejection outlet 5 via movable member 6 upon the liquid ejecting operation and has a free end 6*b* downstream of the fulcrum 6*a*, and it is extended as if it covers the heat generating element 2 with a predetermined distance from the heat generating element 2. The space between the heat generating element 2 and the movable member 6 is a bubble generating region 10.

With this structure, when the heat generating element 2 is actuated, the heat is applied to the liquid on the heat generating element 2, by which a bubble is generated by film boiling phenomenon on the heat generating element 2. The pressure resulting from expansion of the bubble is applied mainly to the movable member 6, and therefore, the movable member 6 is widely opened toward the ejection outlet 5 as indicated by broken line in FIG. 1, generally about the fulcrum 6*a*. By the displacement of the movable member 6 and/or the state thereof, the pressure resulting from the generation of the bubble is propagated, and the expansion of the bubble per se is directed toward the ejection outlet 5, and the liquid is ejected from the ejection outlet 5.

Thus, by the provision, above the bubble generating region 10, of the movable member 6 having a fulcrum 6*a* upstream with respect to the flow of the liquid in the liquid flow path 7 (common liquid chamber 8 side) and the free end 6*b* at the downstream side (ejection outlet 5 side), the pressure propagation of the bubble is directed toward the downstream side, so that pressure of the bubble is directly and therefore effectively used for the liquid ejection. And, the direction of the bubble expansion per se is similarly directed to the downstream side, and therefore, the bubble expands more in the downstream side than in the upstream side. Thus, the expansion direction per se of the bubble is controlled by the movable member to control the pressure propagating direction of the bubble, so that fundamental ejection properties such as the ejection efficiency, ejection power the ejection speed and/or the like.

On the other hand, in the bubble collapse process, the bubble collapses rapidly synergetically with the elastic force of the movable member 6, and the movable member 6 finally restores to the initial position indicated by the solid line in FIG. 1. At this time, the liquid flows into the liquid flow path 7 from the upstream, more particularly, from the common liquid chamber 8 to compensate for the contraction volume of the bubble in the bubble generating region 10 or to compensate for the amount of the ejected liquid (refilling of the liquid). The refilling is efficient because of the restoring function of the movable member 6.

The liquid ejecting head of this embodiment comprises circuits and elements for driving the heat generating element 2 or controlling the driving. The circuits and the element are not concentrated on one of the element substrate 1 and the top plate 3, but are allotted to them on the basis of the functions. Since the element substrate 1 and the top plate 3 are of silicon material, the circuits and the elements can be easily and finely formed through semiconductor wafer processing technique.

The structure of the circuits on the element substrate 1 and the top plate 3 will be described.

Figure 2A:
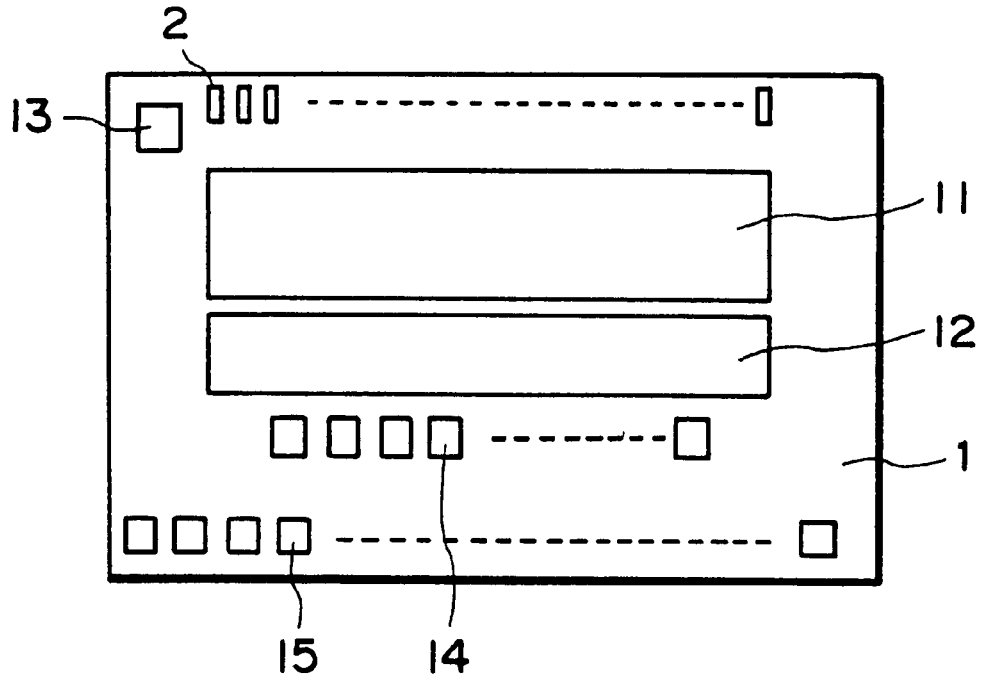
FIG. 2 illustrates a circuit of the liquid ejecting head of FIG. 1, wherein (a) is a top plan view of the element substrate and (b) is a top plan view of the top plate.
Figure 2B:
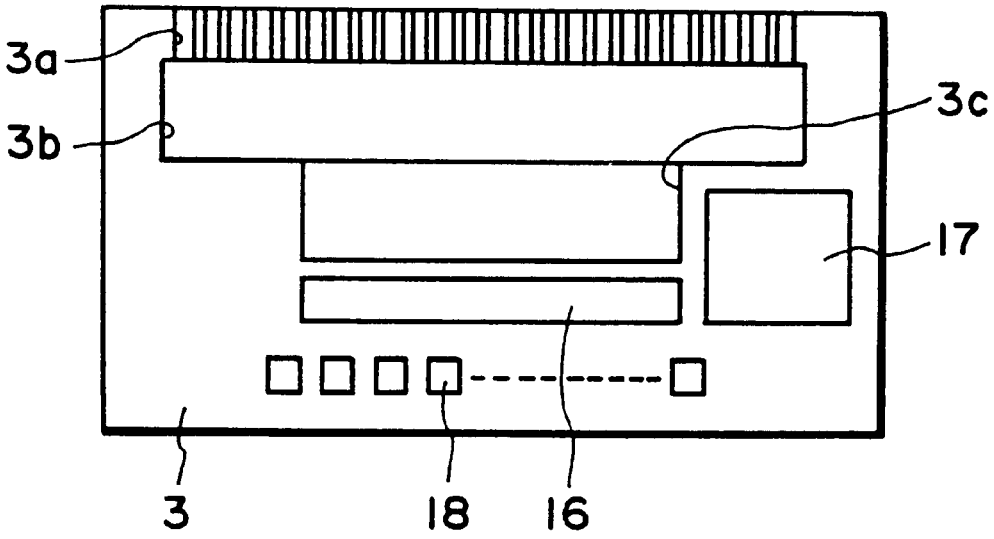

FIG. 2 illustrates a circuit structure of the liquid ejecting head shown in FIG. 1, wherein (a) is a top plan view of the element substrate, (b) is a top plan view of the top plate. In FIG. 2, (a) and (b) show the opposing sides.

As shown in FIG. 2, (a), the element substrate 1 is provided with a plurality of heat generating elements 2 arranged in parallel with each other, drivers 11 for driving the heat generating elements 2 in accordance with the image data, an image data transfer portion 12 for supplying the inputted image data to the driver 11 and a sensor 13 for measuring a parameter necessary for controlling the driving condition for the heat generating element 2.

The image data transfer portion 12 comprises a shift register for outputting the image data supplied in series, to the drivers 11, in parallel, and a latching circuit for storing temporarily the data outputted from the shift register. The image data transfer portion 12 may output the image data to the respective heat generating elements 2 or may output the image data for respective blocks of heat generating elements 2 into which the heat generating element 2 are grouped. By providing a plurality of shift registers for one head and by transmitting the data from the recording device through a plurality of shift registers, the printing speed can be increased easily.

The sensor 13 may be a temperature sensor for sensing the temperature adjacent to the heat generating element 2, or a resistance sensor or the like for monitoring the resistance value of the heat generating element 2.

The ejection amount of the ejected droplet is mainly dependent on the generated bubble volume of the liquid. The generated bubble volume of the liquid is dependent on the temperature of the heat generating element 2 and the portion therearound. Therefore, the temperature of the heat generating element 2 and the temperature therearound are measured, and a pulse of such a small energy as is insufficient for liquid ejection (preheating pulse) is applied before application of a heating pulse for liquid ejection, and the pulse width or the output timing of the preheating pulse is changed in accordance with the output of the sensor, so that temperature of the heat generating element 2 and the temperature therearound is adjusted to assure that constant droplets are ejected, thus maintaining the image quality.

The energy necessary for the bubble generation is represented by a required energy per unit area of the heat generating element 2 multiplied by an area of the heat generating element 2, if the heat radiation condition is constant. The voltage between the opposite ends of the heat generating element 2, the current flowing through the heat generating element 2 and the pulse width thereof, are selected to provide the necessary energy. As regards the voltages applied to the heat generating elements 2, can be maintained substantially constant by supply it from the voltage source of the main assembly of the liquid ejecting apparatus. On the other hand, as regards the currents through the heat generating elements 2, the resistance values of the heat generating elements 2 may be different depending on the lots of the element substrates 1 and individual element substrates 1, because of the variation or the like of the film thicknesses of the heat generating element 2 in the manufacturing process. Therefore, if the pulse width applied to the heat generating element 2 is constant, and the resistance value of the heat generating element 2 is larger than the design value, the current is lower, with the result of insufficiency of the supplied energy, so that bubble generation cannot be proper. On the contrary, when the resistance value of the heat generating element 2 is smaller, the current is larger even when the voltage is the same. In this case, the heat generating element 2 is supplied with excessive energy, with the possible result of damage to, or service life reduction of, the heat generating element 2. Therefore, there is a method wherein the resistance values of the heat generating elements 2 are always monitored by the resistance sensor, and the power source voltage or the heating pulse width is changed in accordance with the resistance value so that heat generating elements 2 are supplied with substantially constant energy.

On the other hand, as shown in FIG. 2, (b), the top plate 3 is provided with grooves 3*a*, 3*b* for constituting the liquid flow paths and the common liquid chamber, as described hereinbefore, and further comprises a sensor driver 17 for driving the sensor 13 provided on the element substrate 1, and a heat generating element controller 16 for controlling the driving condition for the heat generating element 2 in accordance with the output of the sensor driven by the sensor driver 17. The top plate 3 is provided with a supply port 3*c* in fluid communication with the common liquid chamber to permit supply of the liquid into the common liquid chamber for the outside.

The stations of the element substrate 1 and the top plate 3 which are opposed to each other when they are connected, are provided with contact pads 14, 18 for electrical connection between the circuits and the like provided on the element substrate 1 and the circuits and the like provided on the top plate 3. The element substrate 1 is provided with an outer or external contact pad 15 functioning as input contacts for receiving external electric signals. The size of the element substrate 1 is larger than that of the top plate 3, and the external contact pad 15 is extended out of the top plate 3 when the element substrate 1 and the top plate 3 are connected.

The description will be made as to examples of formation processes of the circuits or the like on the element substrate 1 and the top plate 3.

As regards the element substrate 1, the circuits which constitutes the driver 11, the image data transfer portion 12 and the sensor 13 are first formed on the silicon substrate through a semiconductor wafer processing technique. Subsequently, as described hereinbefore, the heat generating element 2 is formed, and finally, the contact pad 14 and the external contact pad 15 are formed.

As regards the top plate 3, the circuits constituting the heat generating element controller 16 and the sensor driver 17 are formed on the silicon substrate by a semiconductor wafer processing technique. Then, as described hereinbefore, the grooves 3*a*, 3*b* constituting the liquid flow paths and the common liquid chamber and the supply port 3*c* are formed by film formation and etching, and finally, the connection contact pad 18 are provided.

The thus constituted element substrate 1 and the top plate 3 are aligned and coupled, by which the heat generating elements 2 are aligned with the liquid flow paths, and the circuits and the like of the element substrate 1 and the top plate 3 are electrically connected with each other through the pads 14, 18. For the electrical connection, gold bumps are placed on the pads 14, 18, although doing so is not inevitable. By the electrical connection using the contact pads 14, 18 on the element substrate 1 and the top plate 3, the electrical connection is established simultaneously with the coupling between the element substrate 1 and the top plate 3.

As shown in FIG. 1, the liquid ejecting head of this embodiment comprises the movable member 6, and therefore, the movable member 6 is placed on the element substrate 1 before the element substrate 1 and the connection is joined with each other. After the coupling between the element substrate 1 and the top plate 3, the orifice plate 4 is connected to the front side of the liquid flow path 7, so that liquid ejecting head 21 (FIG. 3) is provided.

Figure 3:
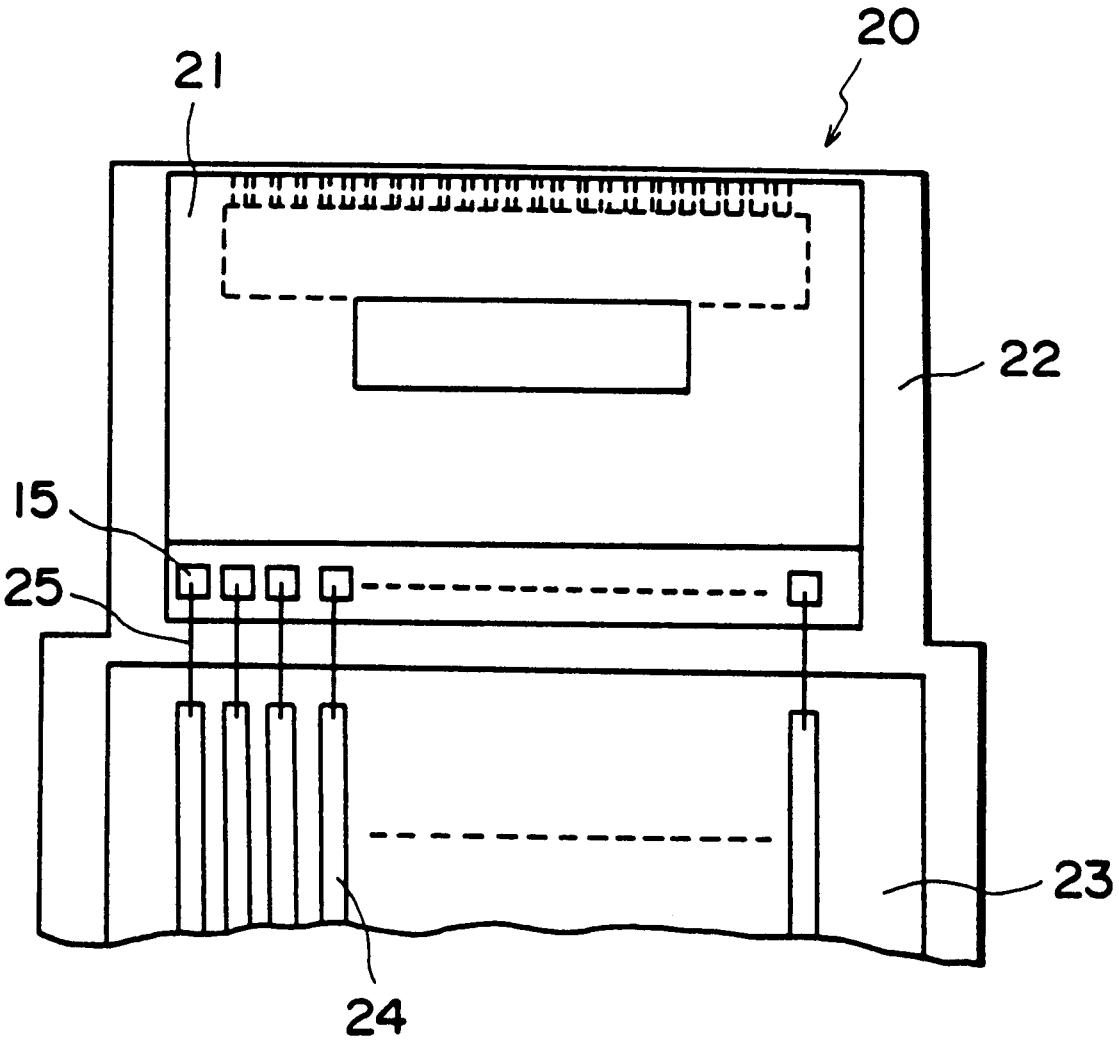
FIG. 3 is a top plan view of a liquid ejecting head unit loaded with the liquid ejecting head of FIG. 1.

When the liquid ejecting head 21 thus manufactured is installed in the liquid ejecting apparatus or is mounted to the head cartridge which will be described hereinafter, the liquid ejecting head 21 is fixed on a base substrate 22 having a print wiring substrate 23 as shown in FIG. 3, so as to constitute a liquid ejecting head unit 20. As shown in FIG. 3, the print wiring substrate 23 is provided with a plurality of wiring patterns 24 for electrical connection with the head controller of the liquid ejecting apparatus, and the wiring patterns 24 are electrically connected with the outer contact pads 15 through the bonding wire 25. The outer contact pads 15 are provided only on the element substrate 1, and therefore, the electrical connection between the liquid ejecting head 21 and the outside can be established in the same manner as in a conventional liquid ejecting head. In this example, the external contact pads 15 are provided on the element substrate 1, but they may be provided on only on the top plate 3 not on the element substrate 1. As described hereinbefore, the various circuits for driving and controlling the heat generating element 2, are distributed to the element substrate 1 and to the top plate 3 in consideration of the electrical connection between the first and second substrates, so that circuits are not concentrated on one substrate, and therefore, the liquid ejecting head can be downsized. By the provision of the electric connecting portions for the electrical connection at portions where the first and the second substrates are connected for constitution of the head, the number of the electrical connecting portions of the head for the external connection is reduced, so that reliability is improved, and the number of parts is reduced, thus accomplishing further downsizing the head.

By not concentrating the circuits on one of the element substrate 1 and the top plate 3, the yield of element substrate 1 can be improved, and as a result, the manufacturing cost of the liquid ejecting head can be reduced. Since element substrate 1 and the top plate 3 are both made of the silicon base material, thermal expansion coefficients of the element substrate 1 and the top plate 3 are the same. As a result, even if the thermal-expansion occurs in the element substrate 1 and the top plate 3, they keep the alignment therebetween, and therefore, the alignment between the respective heat generating elements 2 and the liquid flow paths 7.

In this embodiment, the circuits are divided into an element substrate groups and a top plate group depending on the functions thereof. The criteria of the grouping will be described.

The circuit or circuits corresponding to the individual heat generating elements 2 or to blocks of the heat generating elements 2 through electric wiring, are formed on the element substrate 1. In the example shown in FIG. 2, the drivers 11 and the image data transfer portion 12 are those circuits. Since the heat generating elements 2 receive the driving signals in parallel, the wiring is required for the number of the signals. If such a circuit is formed on the top plate 3, the number of electric connections between the element substrate 1 and the top plate 3 is large with the result of higher liability of the connection defect, but the liability can be reduced by providing those circuits on the element substrate 1.

The analog circuit or circuits such as a control circuit, is provided on the top plate 3 not having the heat generating element 2, since it is easily influenced by heat. In the example shown in FIG. 2, the heat generating element controller 16 is this circuit.

The sensor 13, may be provided either one of the element substrate 1 and the top plate 3, as desired. For example, if it is a resistance sensor, it is desirable to provide it on the element substrate 1 to assure the measurement accuracy. If it is a temperature sensor, it is preferable to provide it on the element substrate 1 (first substrate) when it is for detecting the temperature rise due to abnormality of the heater driving circuit; and when it is for discriminating the state of the ink using the temperature rise of the ink, it is preferable to provide it on the top plate 3 (second substrate) or on each of the element substrate and the top plate.

Other circuits such as a circuit not corresponding to the heat generating elements 2 or blocks of the heat generating elements 2 through electric wiring, or a circuit not required to be provided on the element substrate 1, e.g., a sensor or the like of which the measurement accuracy is not influenced, may be provided on either one of the element substrate 1 and the top plate 3 so as to avoid concentration on one of them. In the example shown in FIG. 2, the sensor driver 17 is this type of circuit.

By distributing the circuits and the sensors on the basis of the criteria described above, they can be distributed with good balance without minimizing the number of electrical connections between the element substrate 1 and the top plate 3.

More specific examples of the circuits will be described. (Example of controlling applied energy to heat generating element)

Figure 4A:
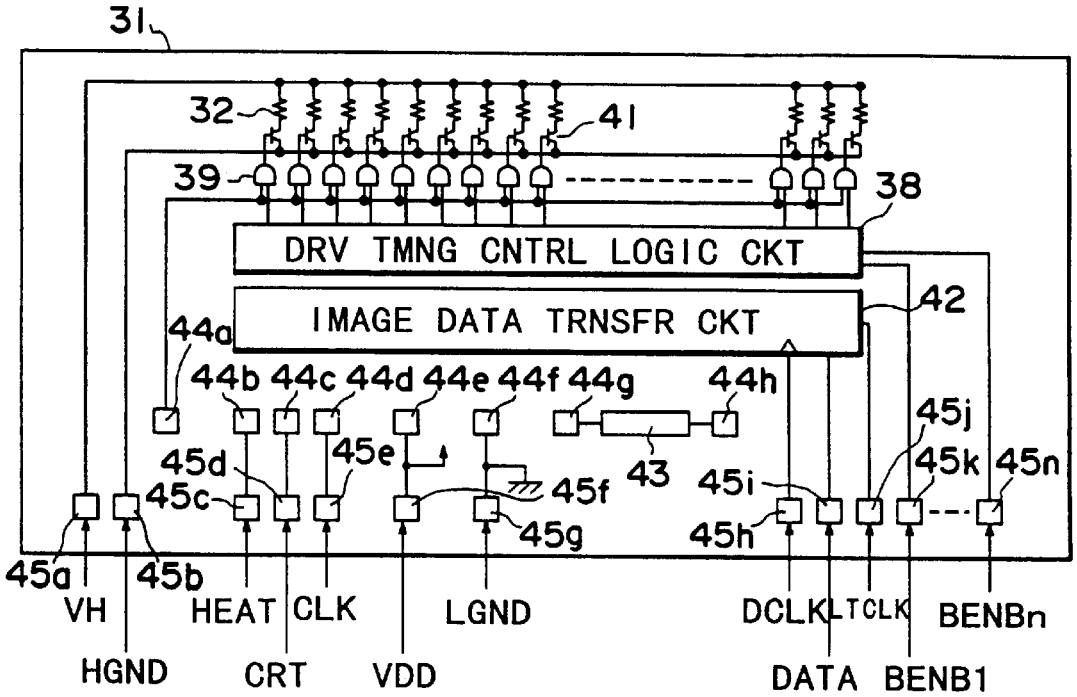
FIG. 4 shows circuits of an element substrate and a top plate in an example wherein applied energy to the heat generating element is controlled in accordance with a sensor output.
Figure 4B:
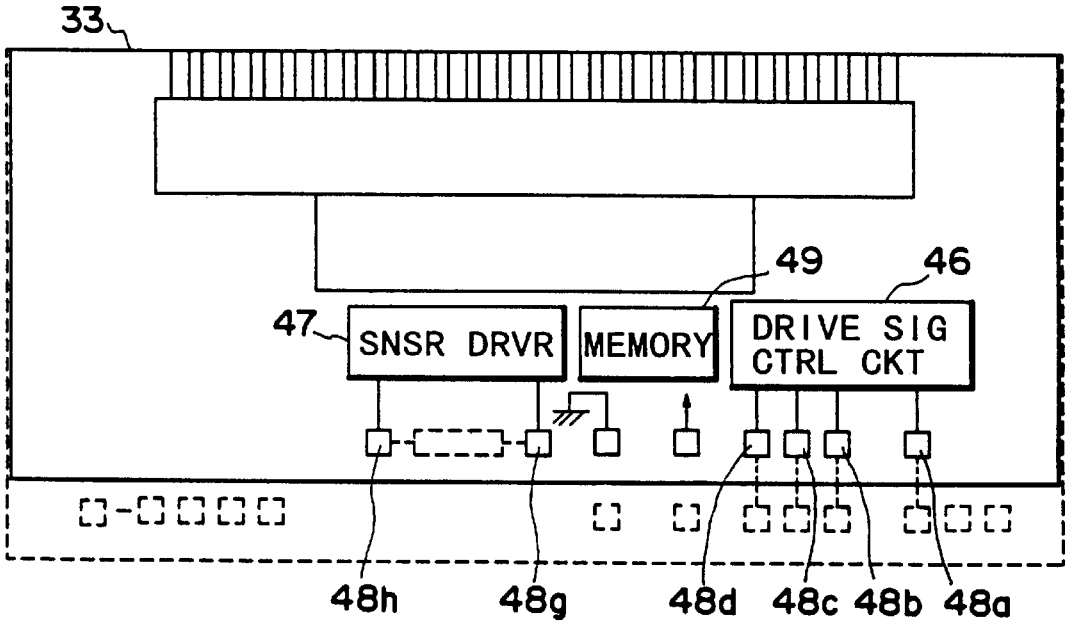

FIG. 4 shows an example of the circuit structures on the element substrate and the top plate in which the applied energy to the heat generating element is controlled in accordance with the sensor output.

As shown in FIG. 4, (a), on the element substrate 31 are formed heat generating elements 32 arranged in a line, power transistors 41 functioning as drivers, AND circuits 39 for controlling the driving of the power transistors 41, a drive timing control logic circuit 38 for controlling the drive timing of the power transistors 41, an image data transfer circuit 42 comprising the shift registers and latching circuits, and a sensor 43 for detecting the resistance value of the heat generating element 32.

The drive timing control logic circuit 38 functions for divided drive of the heat generating elements 32 (the electric power is not supplied simultaneously to all of the heat generating element 32) to reduce the capacity of the voltage source of the apparatus, and an enabling signal for driving the drive timing control logic circuit 38 is supplied through enabling signal input contacts 45*k*–45*n* which are external or outer contact pads.

In addition to the enabling signal input contacts 45*k*–45*n*, the outer contact pads provided on the element substrate 31 include an input contact 45*a* for supplying electric energy to the heat generating elements 32, a grounding contact 45*b* for the power transistors 41, input contacts 45*c*–45*e* for the signal necessary for controlling the energy driving the heat generating elements 32, a driving voltage source contact 45*f* for the logic circuit, a grounding contact 45*g*, an input contact 45*i* for the serial data to be supplied to the shift register of the image data transfer circuit 42, an input contact 45*h* for a serial clock signal in synchronization therewith, and an input contact 45*j* for a latch clock signal to be supplied to the latching circuit.

On the other hand, as shown in FIG. 4, (b), on the top plate 33 are formed a sensor driving circuit 47 for driving the sensor 43, a driving signal control circuit 46 for monitoring the output of the sensor 43 and for controlling the applied energy to the heat generating elements 32 in accordance with outputs of the sensor 43, memory 49 for storing, as head information, the resistance value data sensed by the sensor 43 or a coded rank values of the resistance value data, and the liquid ejection amount properties of the heat generating elements 32 which are measured beforehand (the liquid ejection amounts with a predetermined pulse application under a predetermined temperature) and for outputting the information to the driving signal control circuit 46.

As for the contact pads for the electric connection, the element substrate 31 and the top plate 32 are provided with contacts 44*g*, 44*h*, 48*g*, 48*h* for connection between the sensor 43 and the sensor driving circuit 47, contacts 44*b*–44*d*, 48*b*–48*d* for connection between the input contacts 45*c*–45*e* and the driving signal control circuit 46, and a contact 48*a* for inputting the output of the driving signal control circuit 46 into one of the input contacts of the AND circuit 39, as shown in the Figure.

With such a structure, the resistance value of the heat generating element 32 is detected by the sensor 43, and the results thereof are stored in the memory 43. The driving signal control circuit 46 determines rising and falling data for the driving pulse for the heat generating element 32 in accordance with the resistance value data and the liquid ejection amount property stored in the memory 43, and supplies the determined data to the AND circuit 39 through the contacts 48*a*, 44*a*. On the other hand, the image data inputted in series are stored in a shift register of the image data transfer circuit 42, and are latched in the latching circuit by a latching signal, and is supplied to the AND circuit 39 through the drive timing control circuit 38. By doing so, the pulse width of the heating pulse is determined in accordance with the rising and falling data, and the heat generating element 32 is actuated with the pulse width. As a result, the heat generating element 32 is supplied with a substantially constant energy.

In the foregoing example, the sensor 43 is a resistance sensor. It may be a temperature sensor for detecting a degree of heat accumulation of the heat generating element 32 or for detecting a temperature of the element substrate 31, and the preheating pulse width may be controlled in accordance with the output of the temperature sensor.

In this case, the driving signal control circuit 46 determines the preheat width of the heat generating element 32 in accordance with the liquid ejection amount property determined beforehand and the temperature data detected by the sensor 43, after the voltage source of the liquid ejecting apparatus is actuated. The memory 49 stores selection data for selecting preheat widths corresponding to the respective heat generating elements 32, and when the preheat is actually effected, the preheating signal is selected in accordance with the selection data stored in the memory 49, and then, the heat generating elements 32 are preheated in accordance therewith. In such a manner, the preheating pulse is so selected and applied that ejection amounts of the respective ejection outlets are uniform irrespective of the temperature state. The selection data which determine the preheat width may be once stored at the time of the start of the liquid ejecting apparatus.

In the example of FIG. 4, one sensor 43 is used, but two sensors (resistance sensor and temperature sensor) may be provided, and both of the heating pulse and the preheating pulse are controlled in accordance with the respective outputs, by which the image quality can be further improved.

The head information stored in the memory 49 may include a nature of the liquid to be ejected (when the liquid is ink, the nature may be the color of the ink or the like) in addition to the resistance value data of the heat generating elements. This is because, the properties of the liquids may be different, and therefore, the ejection properties are different. The head information may be stored in the memory 49 after the liquid ejecting head is assembled as non-volatile memory, or the information may be supplied from the apparatus after installation of the liquid ejecting apparatus loaded with the liquid ejecting head.

In the example shown in FIG. 4, the sensor 43 is provided on the element substrate 31, but when the sensor 43 is a temperature sensor, it may be provided on the top plate 33. As regards the memory 49, it may be provided on the element substrate 31 not on the top plate 31 if the element substrate 31 has enough space.

As described in the foregoing, even if the drive or actuation of the heat generating elements 32 are controlled so as to provide good image qualities, the liquid may not be ejected despite the liquid is in the common liquid chamber, if bubbles exist in the common liquid chamber and are introduced to the liquid flow paths with the refilling of the liquid.

As a countermeasurement, a sensor may be provided to detect the presence or absence of the liquid in each of the liquid flow path (particularly, adjacent the heat generating element 32) (detail thereof will be described hereinafter), and when the absence of the liquid may be detected by the sensor, the event may be supplied to the outside. A process circuit for this purpose may be provided on the top plate 33. In this case, the liquid in the liquid ejecting head is forcedly sucked out through the ejection outlets by the liquid ejecting apparatus in response to the output of the process circuit, by which the bubble in the liquid flow path can be removed. The sensor for detecting the presence or absence of the liquid may effect the detection using the change of the resistance value through the liquid or using an abnormal temperature rise of the heat generating element in the absence of the liquid.

(Example of controlling temperature of element substrate)

Figure 5A:
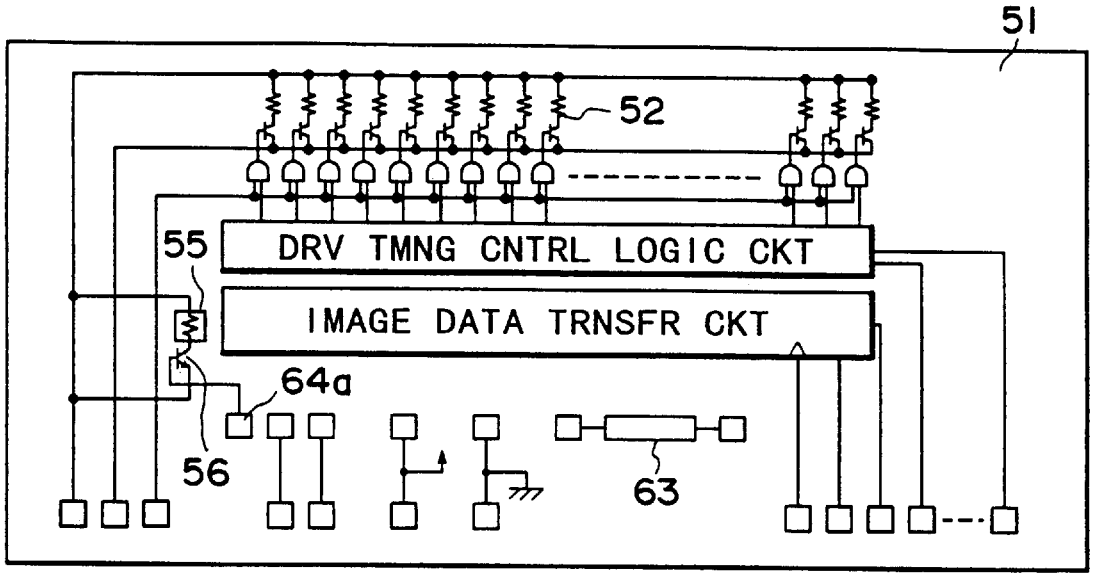
FIG. 5 shows circuits of an element substrate and a top plate in an example wherein a temperature of the element substrate is controlled in accordance with a sensor output.
Figure 5B:
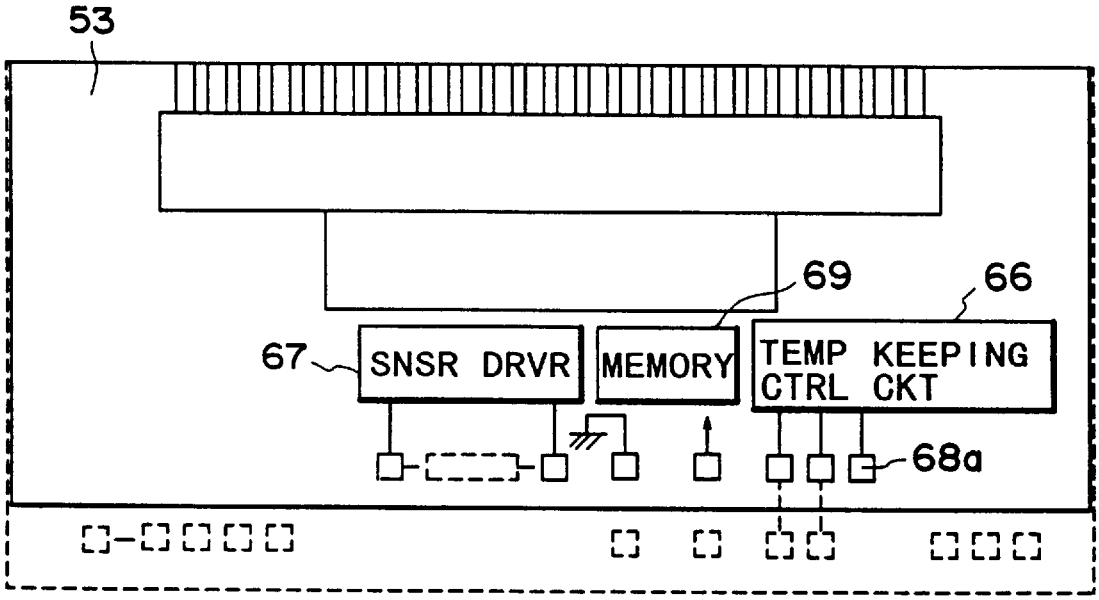

FIG. 5 shows an example of circuit structures on the element substrate and the top plate for controlling the temperature of the element substrate in accordance with a sensor output.

In this example, as shown in FIG. 5, (a), on the element substrate 51 is formed a temperature keeping heater 55 for heating the element substrate 51 per se to control the temperature of the element substrate 51 in addition to the heat generating elements 52 for the liquid ejection, and a power transistor 56 as a driver for the temperature keeping heater 55, as compared with the element substrate 31 shown in FIG. 4, (a). The sensor 63 is a temperature sensor for measuring the temperature of the element substrate 51. On the other hand, as shown in FIG. 5, (b), on the top plate 53 is formed a sensor driving circuit 67 for driving the sensor 63 and a temperature keeping heater control circuit 66 for monitoring the output of the sensor 63 and for controlling the driving of the temperature keeping heater 55 in accordance with the output of the sensor 63, in addition to the memory 69 storing the liquid ejection amount properties. The temperature keeping heater control circuit 66 includes a comparator which compares an output of the sensor 63 with a threshold predetermined on the basis of the temperature required for the element substrate 51, and when the output of the sensor 63 is higher than the threshold, a temperature keeping heater control signal for driving the temperature keeping heater 55 is outputted. The temperature required for the element substrate 51 is such a temperature with which the viscosity of the liquid in the liquid ejecting head is within a stable ejection range.

Contacts 64*a*, 68*a* for inputting a temperature keeping heater control signal outputted from the temperature keeping heater control circuit 66 to the power transistor 56 for the temperature keeping heater formed on the element substrate 51, are provided on the element substrate 51 and the top plate 53 as contact pads. The structures in the other respect is the same as those shown in FIG. 4, and therefore, the detailed explanation is omitted for simplicity.

With this structure, the temperature keeping heater 55 is actuated by the temperature keeping heater control circuit 66 in accordance with the output of the sensor 63, so that temperature of the element substrate 51 is maintained at a predetermined temperature. As a result, the viscosity of the liquid in the liquid ejecting head is maintained within a stable ejection range, thus assuring proper ejection.

Individual sensors usable as the sensor 63 involves variation in the voltage outputs. Therefore, a further accurate temperature control is desired, a correction value for compensating the variation may be stored in the memory 69 as head information, and the threshold set in the temperature keeping heater control circuit 66 may be adjusted in accordance with, the correction value stored in the memory 69. In the embodiment of FIG. 1, the grooves constituting the liquid flow paths 7 are formed in the top plate 3, and the movable members 6 are manufactured in a process separate from that for the element substrate 1, and the member provided with the ejection outlets 5 ((orifice plate 4) is made of a member separate from the element substrate 1 and from the top plate 3. However, the present invention is not limited to this case.

FIGS. 6–10 show another example of the element substrate and the top plate. The example of FIGS. 4 and 5 is applicable to the liquid ejecting heads according to the embodiments of FIGS. 6–10, which will be described. In the following description, the structure of the liquid ejecting head is taken, and the structure of the electric circuits are omitted for simplicity.

Figure 6A:
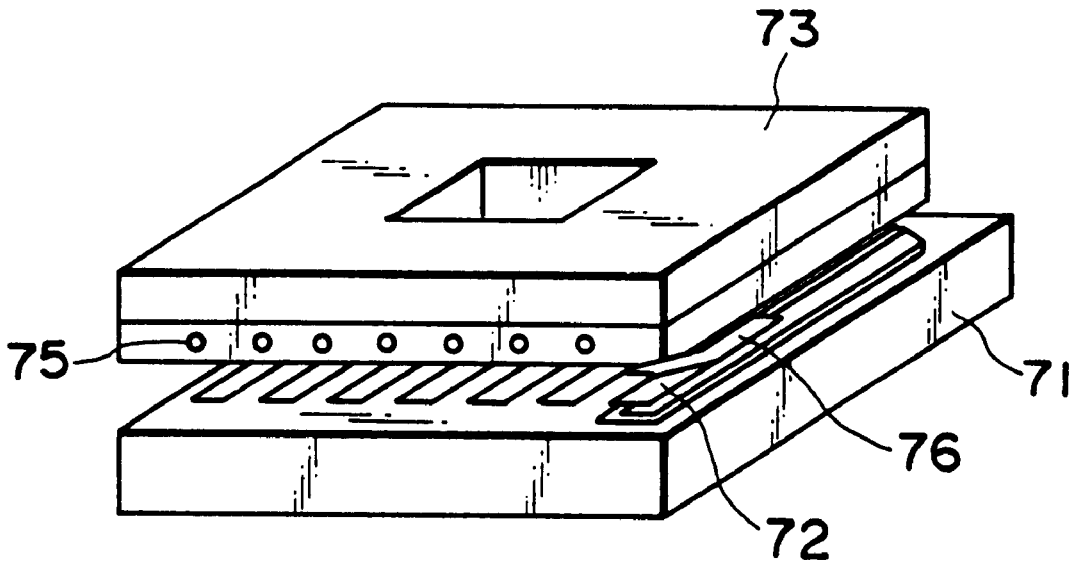
FIG. 6 is a perspective view and a sectional view of a liquid ejecting head according to another embodiment of the present invention.
Figure 6B:
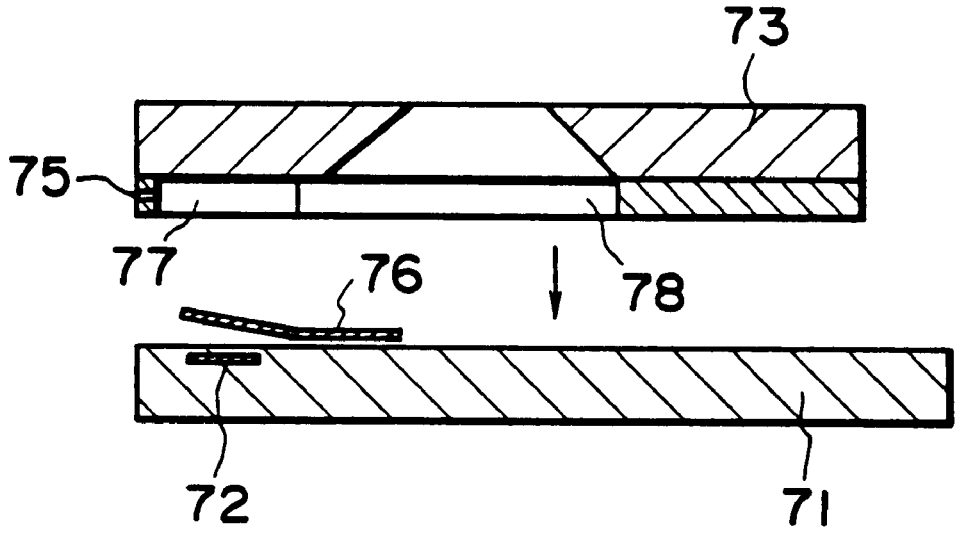

In the example of FIG. 6, the movable members 76 are built in the element substrate 71, and the top plate 3 is provided with the ejection outlets 75. The movable member 76 is directly formed on the element substrate 71 through a film formation process after the heat generating element 72 is formed on the element substrate 71. At this time, the upper part of the heat generating element 72 is treated for weakening the contact, by which the movable member can be formed into a cantilever. As regards the top plate 73, when the grooves constituting the liquid flow paths 77 and the common liquid chamber 78 are formed in the top plate 73, a wall having a thickness of the orifice plate is caused to remain at the end surface of the top plate 73, and the ejection outlets 75 are formed through the wall by ion beam machining, electron beam process or the like.

Figure 7A:
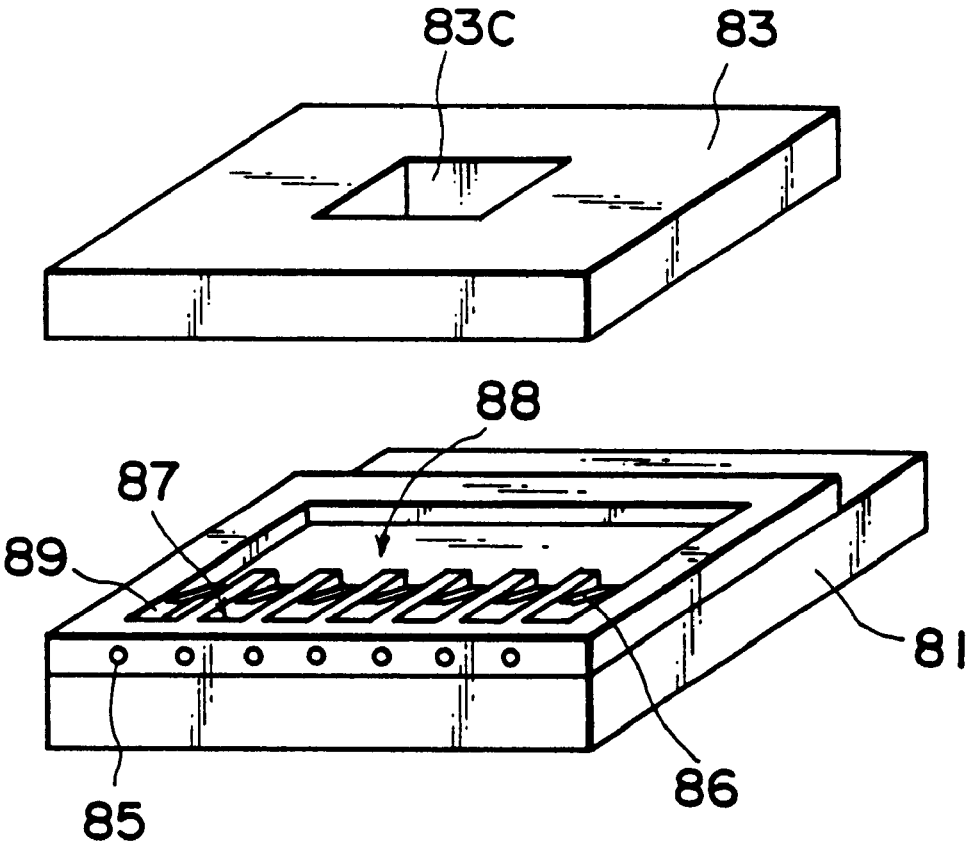
FIG. 7 is a perspective view and a sectional view of a liquid ejecting head according to a further embodiment of the present invention.
Figure 7B:
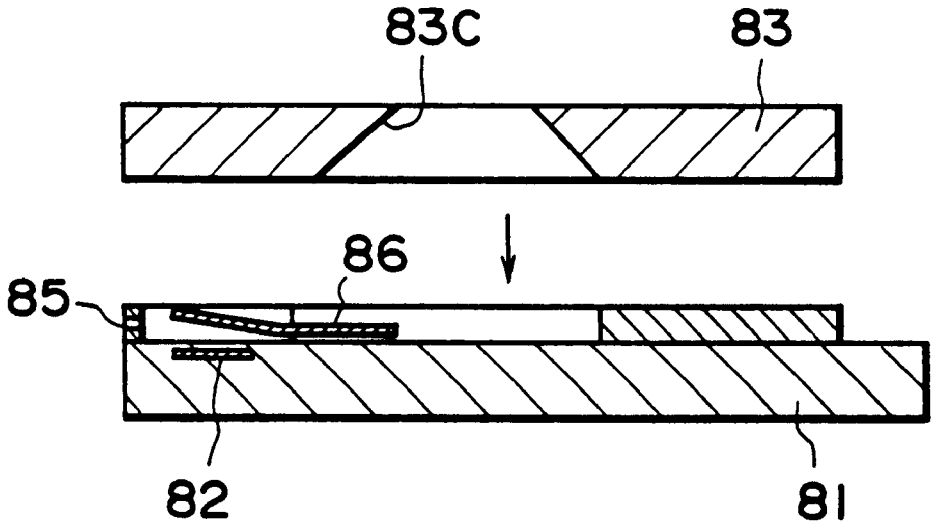

In the example shown in FIG. 7, the grooves constituting the liquid flow paths 87 and common liquid chamber 88 are formed in the element substrate 81, and the top plate 83 has a supply port 83*c* only as an opening. After the heat generating elements 82 are formed on the element substrate 81, the movable members 86 are formed on the element substrate 81. Thereafter, the material comprising as a main material silicon material such as silicon nitride, silicon oxide or the like is formed into a film on the element substrate 81, and then, the portions of the walls corresponding to the orifice plate and the side walls 89 of the flow paths, are patterned. Subsequently, similarly to FIG. 6, ejection outlets 85 are formed, and finally, the top plate 83 is connected. In this example, the heat generating elements 82, the liquid flow paths 87, the movable members 86 are all formed using semiconductor wafer processing technique, and the ejection outlets 85 are formed by patterning, so that liquid flow paths are provided with high accuracy. Accuracy of the fastening of the top plate 83 is dependent on the machine assembling accuracy, but what is done is to connect the supply ports 83*c* with the liquid flow paths 87, and the ejection performance is determined by the liquid flow passage configurations, and therefore, a less expensive assembling machine is enough for the desired accuracy.

Figure 8A:
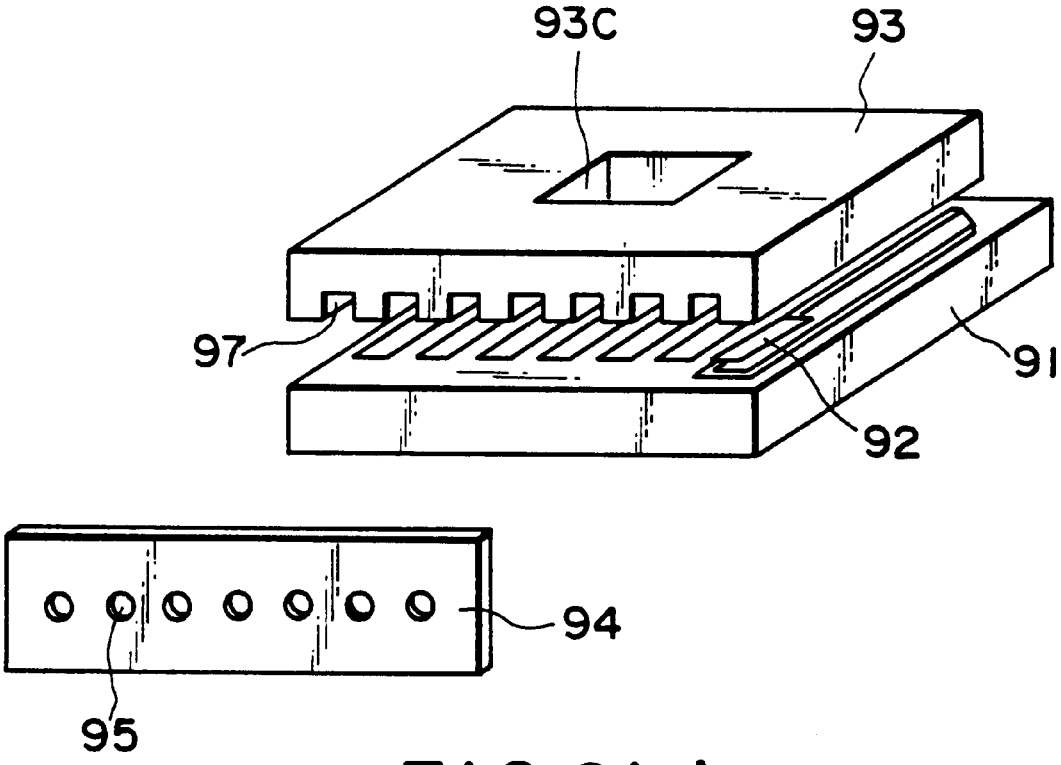
FIG. 8 is a perspective view and a sectional view of a liquid ejecting head according to a further embodiment of the present invention.
Figure 8B:
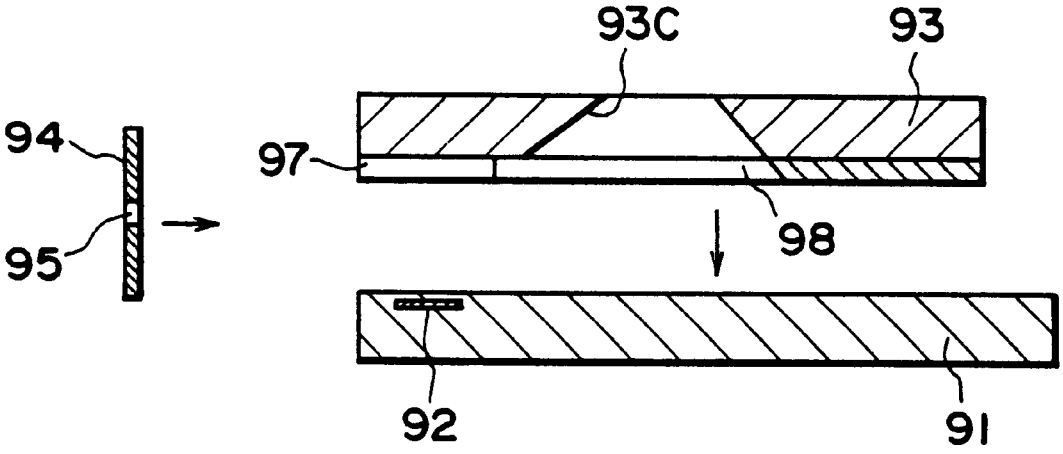

In the example shown in FIG. 8, the liquid ejecting head is an ordinary one not having the movable member, and the structure thereof is the same as that of FIG. 1 in the other respects. More particularly, grooves constituting the liquid flow paths 97 and the common liquid chamber 98 are formed in the element substrate 91 having the heat generating elements 92 formed thereon, and the top plate 93 having the supply port 93*c* formed therein is fastened thereto, and then, an orifice plate 94 having the ejection outlets 95 formed therein is connected or fastened to the front end of the united element substrate 91 and top plate 93.

Figure 9A:
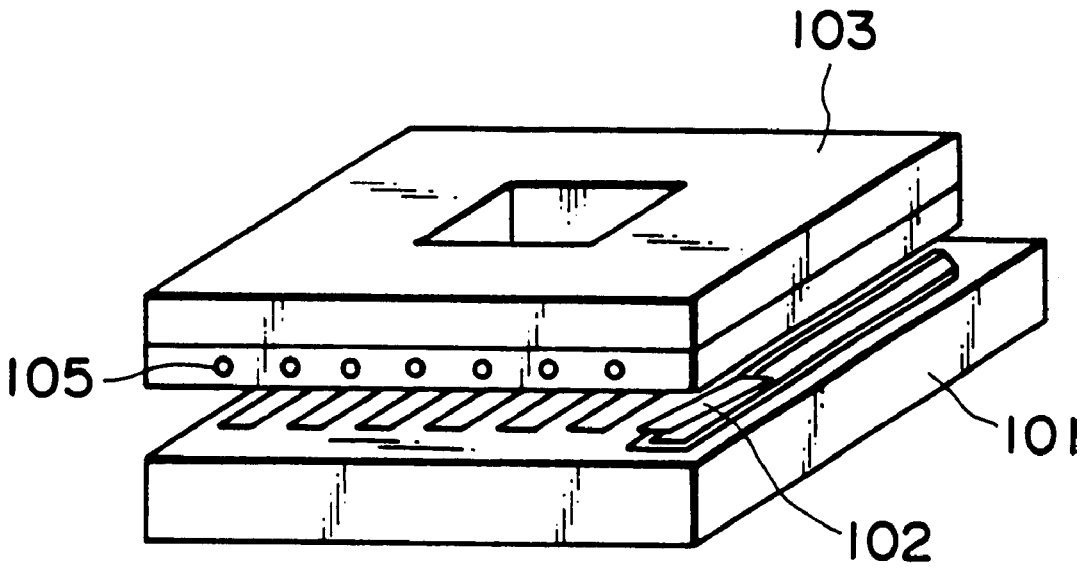
FIG. 9 is a perspective view and a sectional view of a liquid ejecting head according to a further embodiment of the present invention.
Figure 9B:
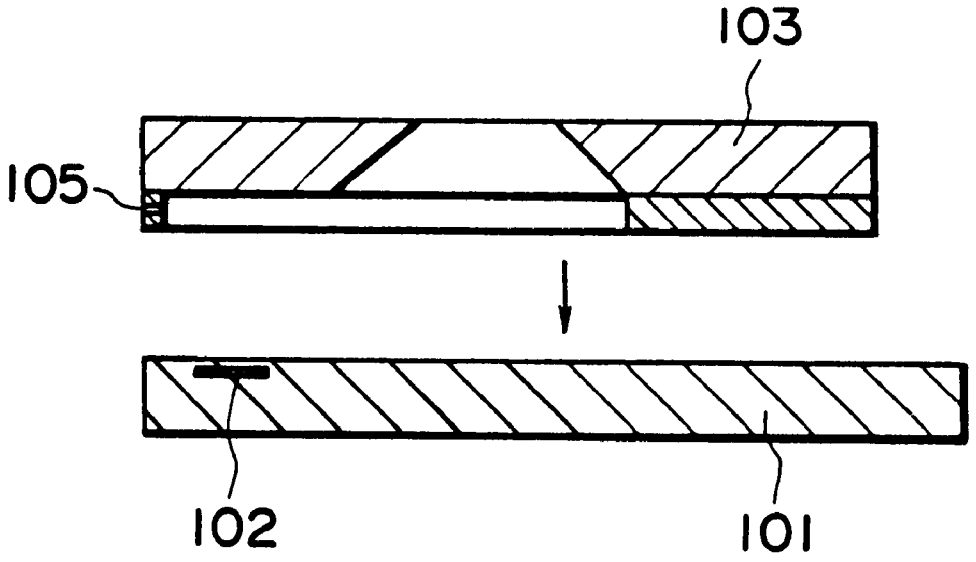

In the example of FIG. 9, there is not provided a movable member, and the ejection outlets 105 are formed in the top plate 103. In the element substrate 101, only the heat generating elements 102 are formed, and the other structures are the same as that shown in FIG. 6, and therefore, the detailed description thereof is omitted.

Figure 10A:
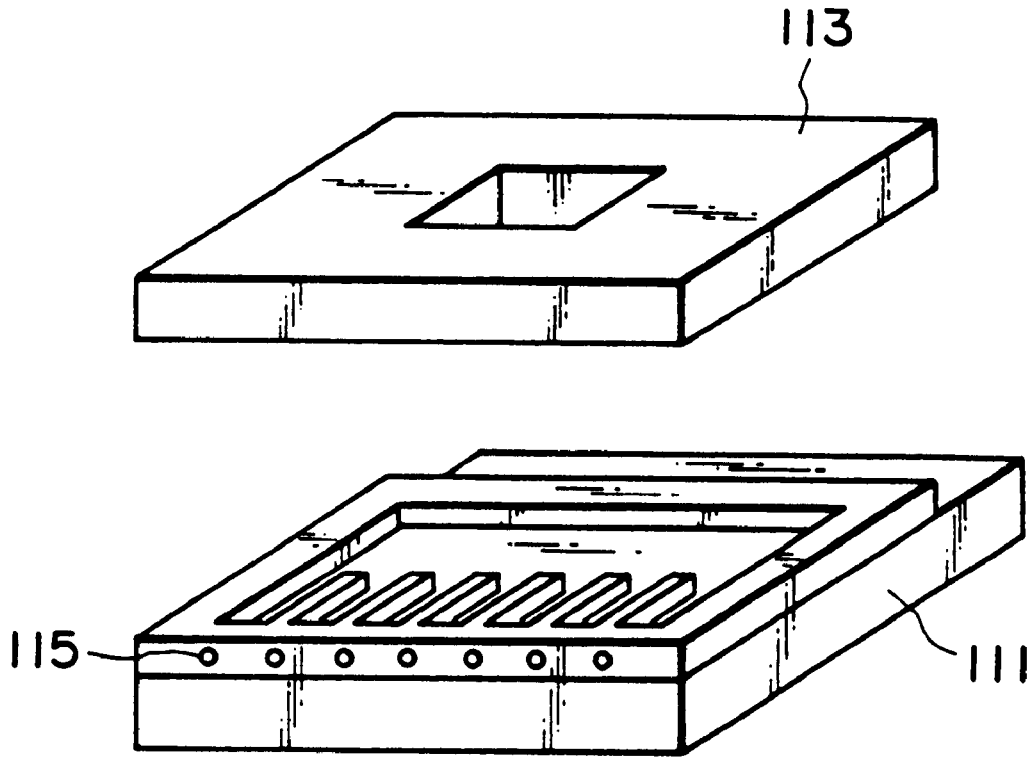
FIG. 10 is a perspective view and a sectional view of a further example of a liquid ejecting head according to the present invention.
Figure 10B:
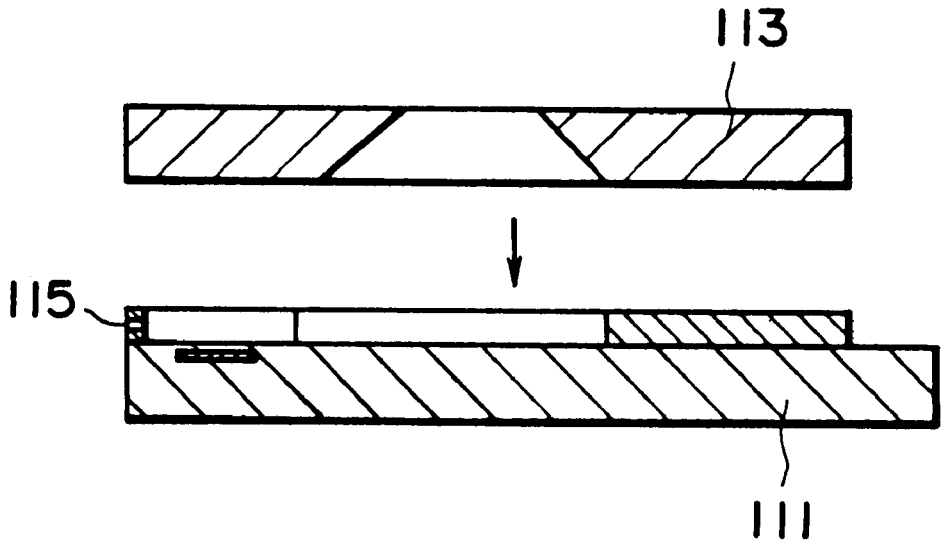

In the example shown in FIG. 10, there is not provided a movable member, and the ejection outlets 115 are formed in the element substrate 111. The structure of the element substrate 111 is the same as that shown in FIG. 7 except that movable member is not provided, and the structure of the top plate 113 is the same as that shown in FIG. 7, so that detailed description thereof is omitted.

Referring to FIGS. 11–15, the description will be made as to a head driving operation in accordance with a result of detection and detection of presence/absence of the ink, using the temperature sensor.

FIGS. 11–15 show a further structures of circuits the element substrate and the top plate of the liquid ejection recording head according to embodiments of the present invention, in each of which (a) is a top plan view of the element substrate, and (b) is a top plan view of the top plate. These Figures show the opposing surfaces similarly to FIG. 2 in (a) and (b), and the broken lines on (b) indicates the position of the liquid chamber and the Figure when they are united.

The heads shown in FIGS. 11–15 are not provided with the movable member shown in FIG. 10, and the ejection outlets are formed in the element substrate, but as regards the structures of the element substrate and the top plate, they are applicable to any examples having been shown. In the following description, the examples can be combined within the sprit of the present invention, unless particular mentioning to the contrary is made. In the following examples, the like reference numerals or characters are assigned to the elements having the corresponding functions.

Figure 11A:
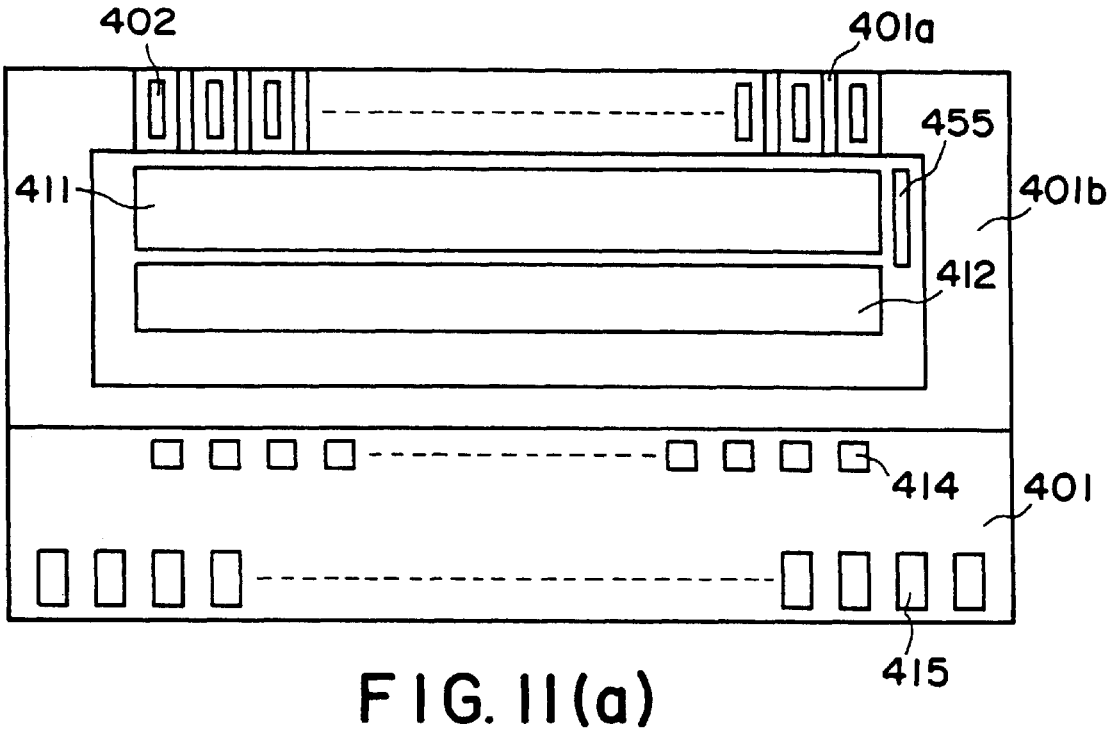
FIG. 11 shows an element substrate and a top plate in an embodiment wherein presence or absence of the ink is detected an the basis of an output of a temperature sensor.
Figure 11B:
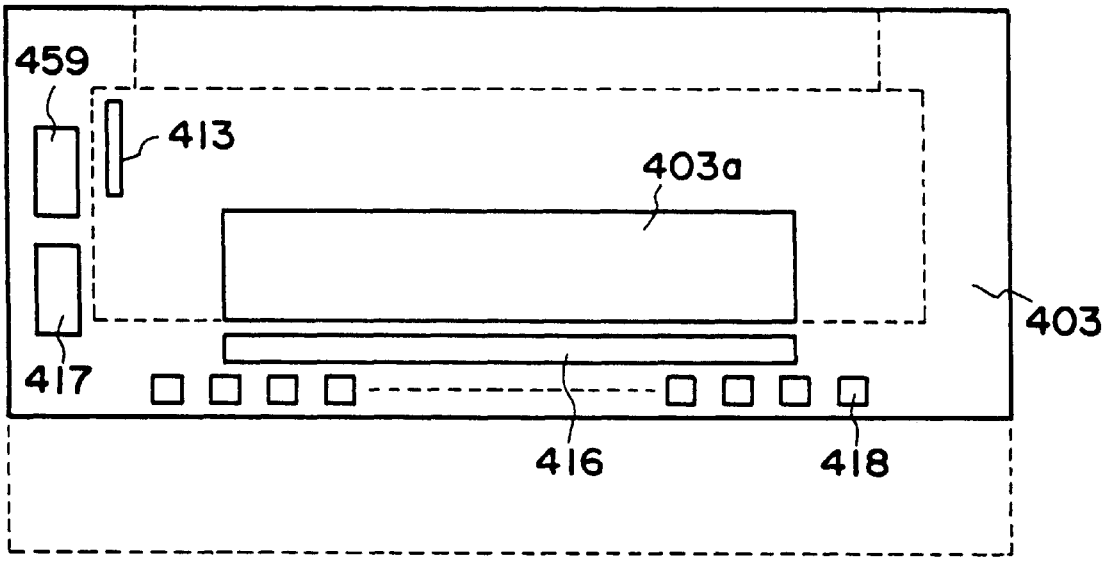

In FIG. 11, (a), the element substrate 401 are provided with a plurality of heat generating elements 402 arranged in parallel corresponding to the flow paths described above, a sub-heater 455 in the common liquid chamber, drivers 411 for actuating the heat generating elements 402, an image data transfer portion 412 for outputting the image data to the driver 411, flow passage walls 401*a* for constituting the nozzles and a liquid chamber frame 401*b*.

On the other hand, in FIG. 11, (b), the top plate 403 is provided with a temperature sensor 413 for measuring a temperature in the common liquid chamber, a sensor driver 417 for actuating the temperature sensor 413, a limitation circuit 459 for limiting or stopping driving of the heat generating resistors, a heat generating element controller 416 for controlling a driving condition of the heat generating elements 402 on the basis of the signals from the sensor driver 417 and the limitation circuit 459, and a supply port 403*a* in fluid communication with the common liquid chamber to supply the liquid into the common liquid chamber from outside.

Additionally, the opposing surfaces of the element substrate 401 and the top plate 403 are provided with connection contact pads 414, 418 for electrical connection between the circuits or the like formed on the element substrate 401 and the circuits or the like formed the top plate 403. The element substrate 401 is provided with an outer or external contact pad 415 functioning as input contacts for receiving external electric signals. The size of the element substrate 401 is larger than that of the top plate 403, and the external contact pad 415 is extended out of the top plate 403 when the element substrate 1 and the top plate 403 are connected. They are formed in the same manner as with FIG. 2 embodiment. The thus constituted element substrate 401 and the top plate 403 are aligned and coupled, by which the heat generating element 402 are aligned with the liquid flow paths, and the circuits and the like of the element substrate 401 and the top plate 403 are electrically connected with each other through the contact pad 414, and 418.

The ink is filled in a gap of several tens microns between the first substrate (element substrate 401) and the second substrate (top plate 403). When the heating is carried out by the sub-heater 455, the heat transfer to the second substrate is different depending on the presence or absence of the ink. The difference of the heat transfer is detected by a temperature sensor 413 constituted by a diode sensor or the like having PN junction to discriminate the presence or absence of the ink in the liquid chamber. Therefore, when an abnormal temperature, as compared with that when the ink is present, is detected on the basis of the detection result by the temperature sensor 413, the actuation of the heater 402 is limited or stopped by the limitation circuit 459, or a signal indicative of the abnormality is supplied to the main assembly, so that physical damage of the head can be prevented, and the stabilized ejection performance can be maintained.

According to the present inventions the temperature sensor and the limitation circuit can be manufactured through the semiconductor wafer processing technique, and therefore, the elements can be placed at the optimum locations, and the damage preventing function for the head can be added without cost rise.

Figure 12A:
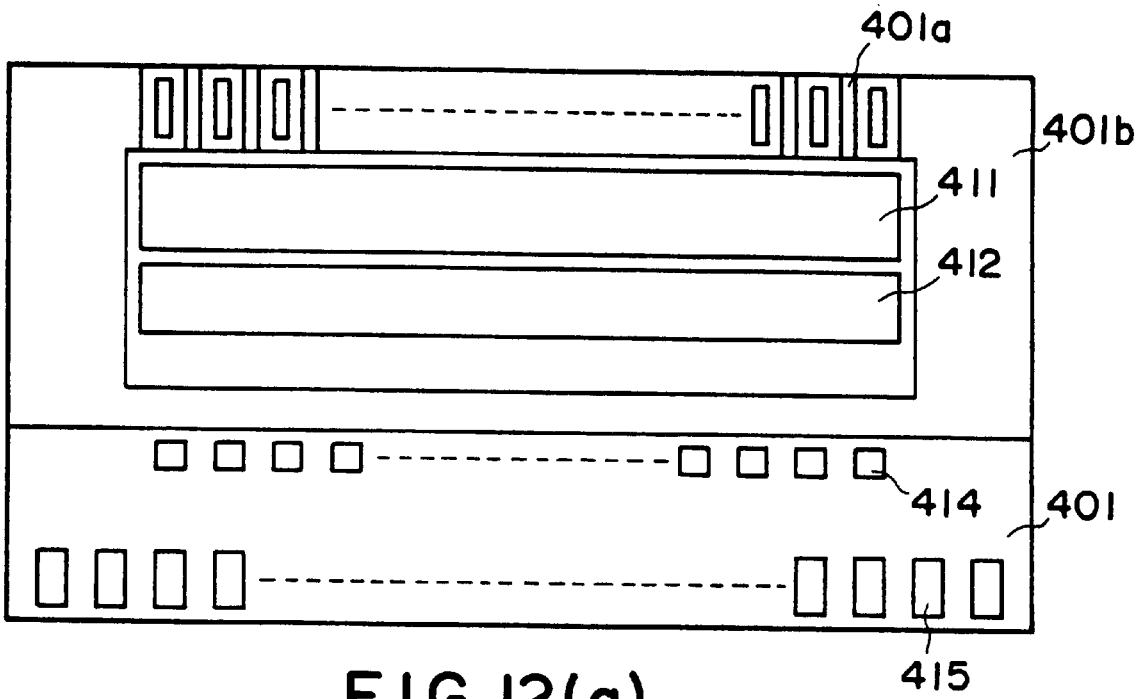
FIG. 12 shows a modified embodiment of the element substrate and the top plate of FIG. 11 wherein circuit structures are modified.
Figure 12B:
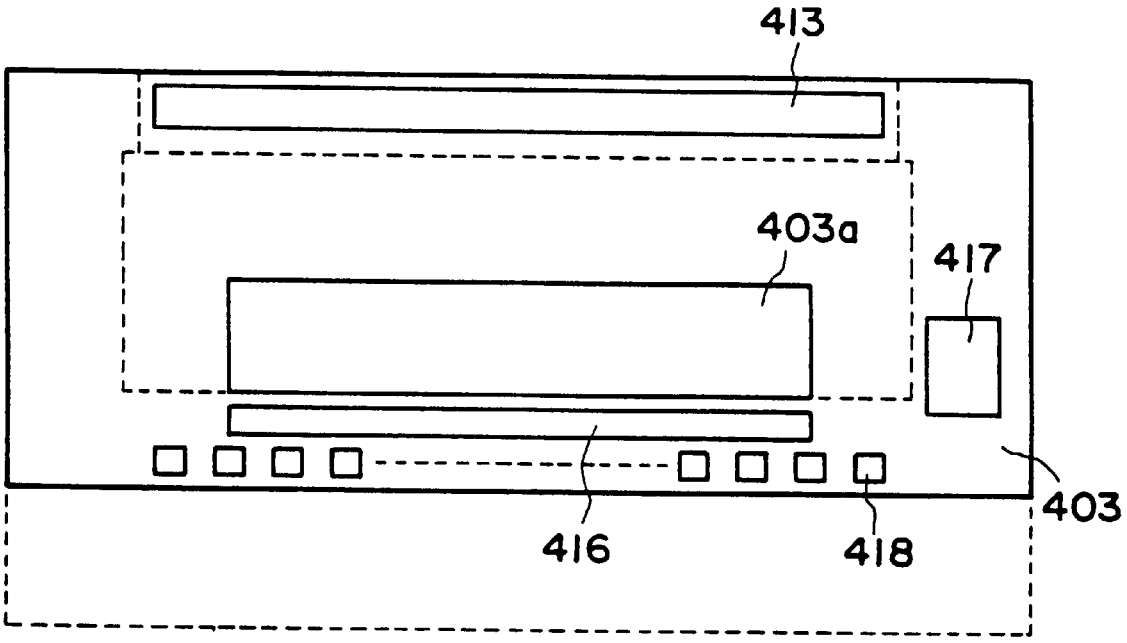

FIG. 12 shows a modification of FIG. 11 embodiment, and in this modified example, the use is made with an election heater i.e. heat generating resistor 402 rather than the sub-heater, as is different from FIG. 11 embodiment. In the modified example of FIG. 12, the temperature sensor 413 is provided in a region on the top plate 403 opposed to the heat generating elements 402, and effects the detection of presence/absence by detecting the temperature when the heat generating elements 402 are operated with a short pulse not enough for bubble generation or with low voltage. It is possible to monitor the temperature while the liquid is being ejected, in addition to the detection of presence/absence and feed the monitored output back to the driving system. The structure of this modified example is particularly effective when the sub-heater is not easily disposed in the common liquid chamber. In this this modified example, the heat generating element controller 416 limits or stops the head driving on the basis of the output of the temperature sensor 413.

Figure 13A:
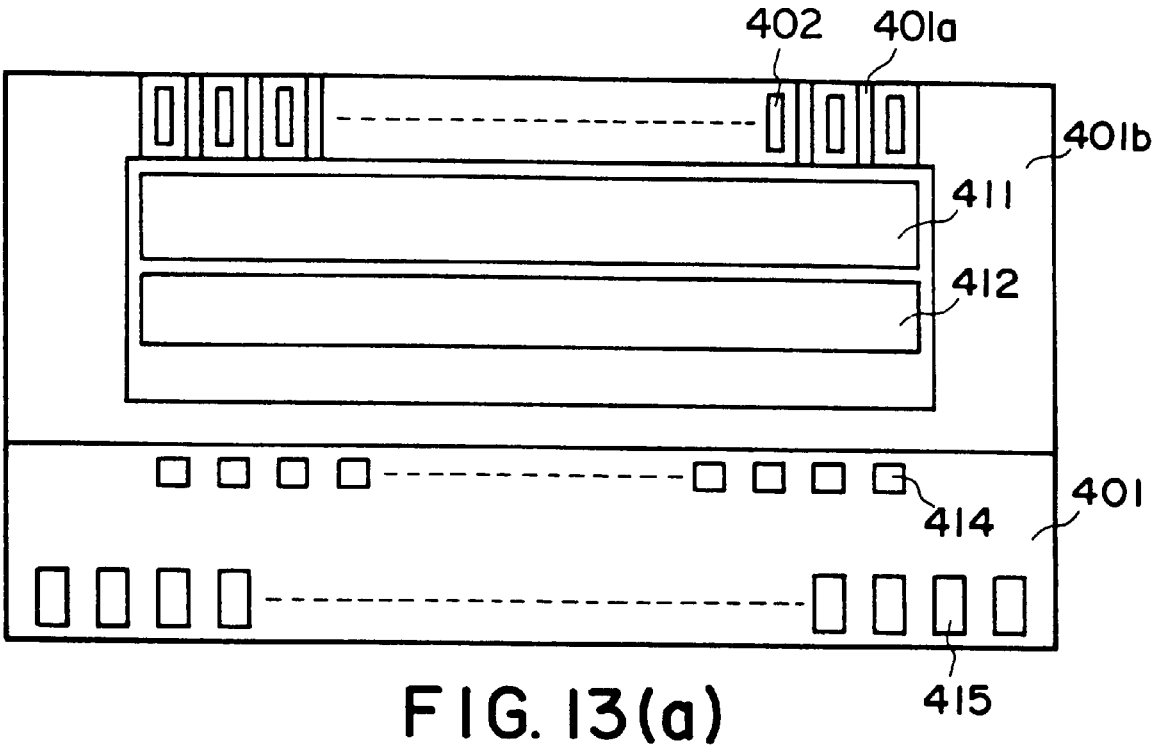
FIG. 13 shows a modified embodiment of the element substrate and the top plate of FIG. 11 wherein circuit structures are modified.
Figure 13B:
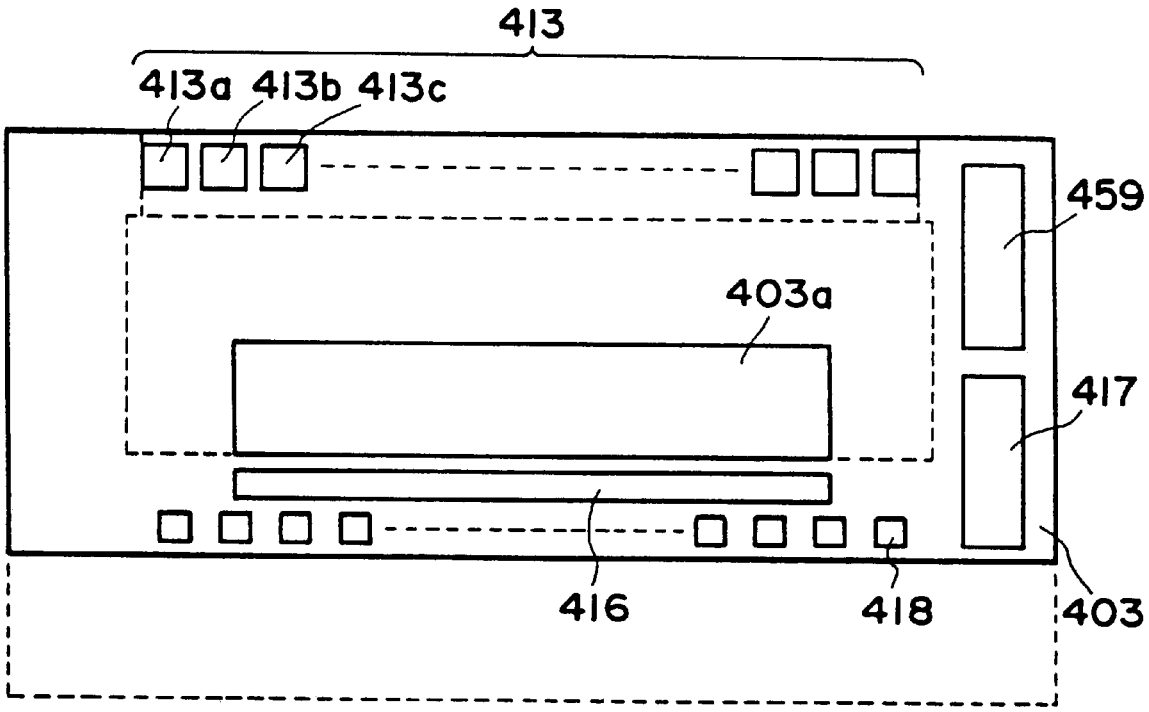

FIG. 13 shows a modification, in which temperature sensors 413 are provided corresponding to groups of different heat generating elements 402 (in the Figure, 413*a*, 413*b*, 413*c* or the like correspond to the respective nozzles). Since the heat generating elements 402 can be selectively driven, the state of ink (ink presence or absence) can be detected for a smaller area by the provision of a plurality of temperature sensors.

By the provision of the temperature sensors in one-to-one relationship to the heat generating elements as in this embodiment, the temperature change upon the liquid ejection can be detected for respective nozzles, and therefore, the presence or absence of the ink In the nozzle and/or the bubble generation state can be detected on the basis of the temperature. As regards detection of a partial ejection failure for each nozzle due to ink shortage, memory disclosed in FIG. 15 may be provided, which stores data indicative of normal ejection, which data is used for comparison. Alternatively, the data of adjacent nozzles may be compared. For example, if 413*b* only is abnormal among 413*a*, 413*b*, 413*c*, for example, the nozzle 413*b* is discriminated as being abnormal.

In this case, the temperature sensors 413*a*, 413*b*, 413*c* . . . are not connected with the respective heat heat generating resistors through the electrical wiring connection, and therefore, there arises no such a problem that wiring is complicated even if they are provided on the second substrate (top plate 403). Even when a plurality of sensors are provided, the cost rising can be avoided by using semiconductor wafer process, according to the present invention. For this reason, the present invention is particularly preferably used with a full-line head.

Figure 14A:
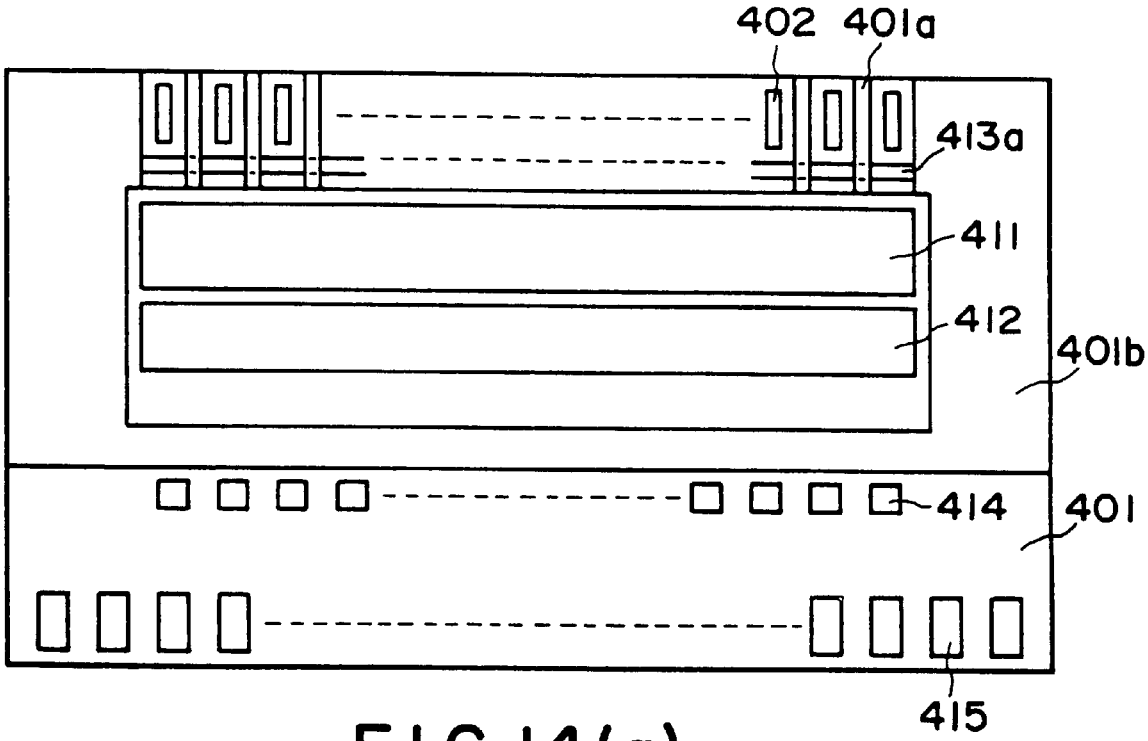
FIG. 14 shows a modified embodiment of the element substrate and the top plate of FIG. 11 wherein circuit structures are modified.
Figure 14B:
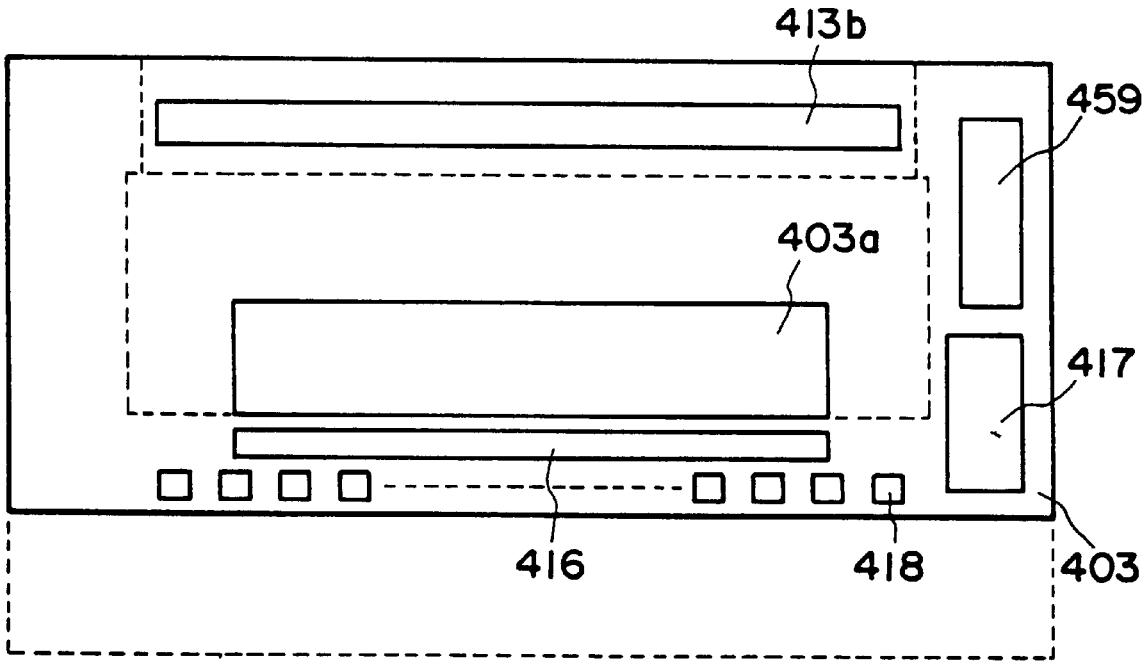

In the modified example of FIG. 14, the temperature sensors 413*a*, 413*b* are provided on the first and second substrates (element substrate 401 and top plate 403) respectively, as is different from the modified example of showing. When the temperature sensor is disposed only on one of the substrates, and the threshold between the presence and absence of the ink changes with the ambience heating or the state of the head (for example, immediately after the completion of the printing operation), the control may be improper. But, by the measurement of the difference in the temperature rise by the two sensors during heating, the state of the ink such as ink presence/absence can be more correctly detected than when the sensor is provided only on one substrates.

Figure 15A:
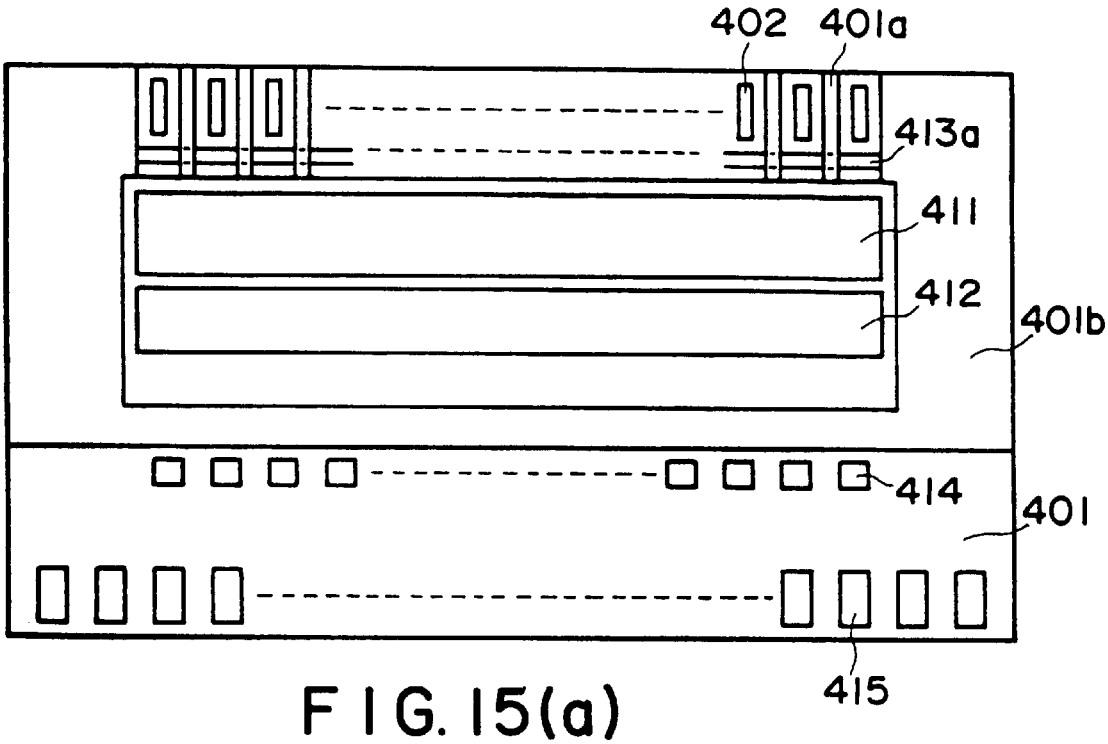
FIG. 15 shows a modified embodiment of the element substrate and the top plate of FIG. 11 wherein circuit structures are modified.
Figure 15B:
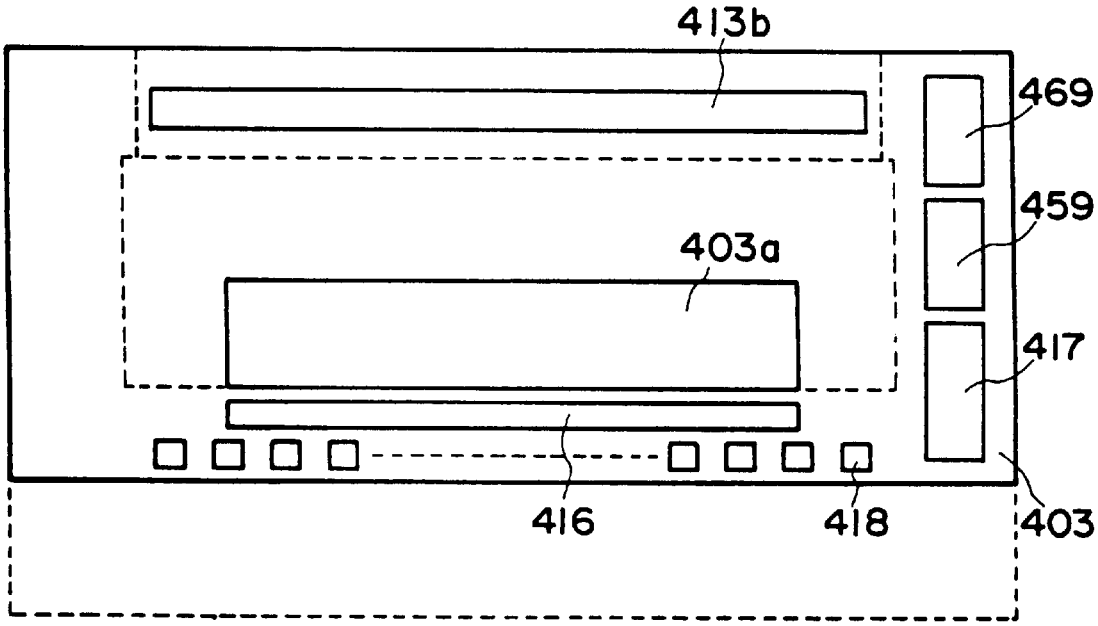

In a modified example of FIG. 15, during the manufacturing process, memory 469 is provided which stores the temperature changes upon actuation of the heat generating resistor when the ink exists and when the ink does not exist, as head information, and which outputs the stored data to a heat generating element controller 416. By the provision of the memory 469 and comparison between the stored data and the output of the sensor, higher accuracy detection of ink presence/absence is accomplished.

The memory may store the head information such as liquid ejection amount properties of the heat generating elements 402 which have been determined beforehand (the liquid ejection amount upon predetermined pulse application at a constant temperature), the used ink or the like.

In the foregoing, the present invention has been described. The description will be made as to structures usable with the present invention.

The description will be made as to a liquid ejection head cartridge having a liquid ejecting head of the embodiment.

Figure 16:
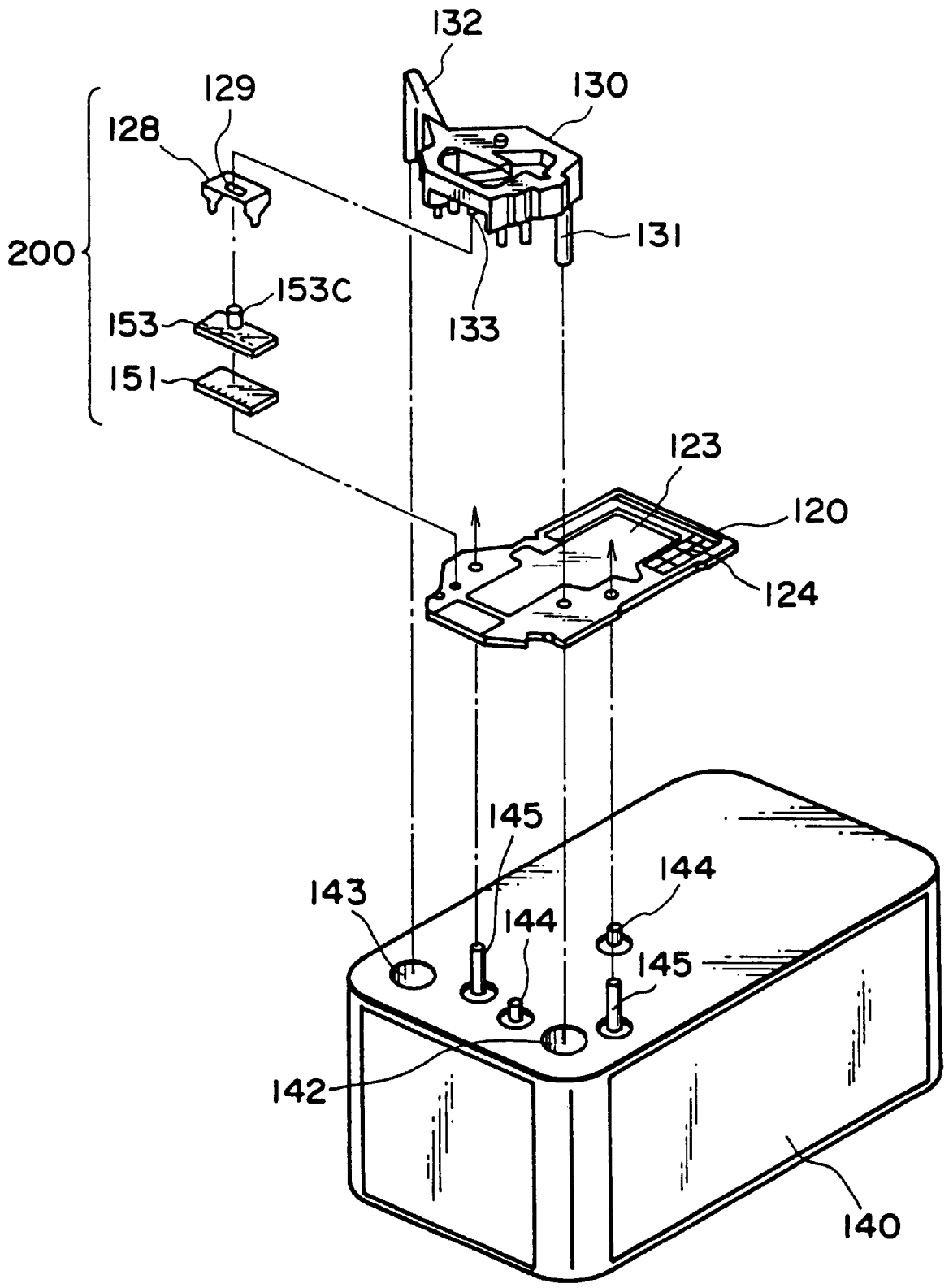
FIG. 16 is an exploded perspective view of a liquid ejection head cartridge usable with the present invention.

FIG. 16 is a schematic exploded perspective view of a liquid ejection head cartridge including the liquid ejecting head described in the foregoing, and the liquid ejection head cartridge is generally constituted by a liquid ejecting head 200 and a liquid container 140.

The liquid ejecting head 200 comprises an element substrate 151, a top plate 153 provided with an ejection outlet, a confining spring 128, a liquid supply member 130, a aluminum base plate (supporting member) 120. The element substrate 151 is provided with an array of heat generating resistors for applying heat to the liquid as described hereinbefore. By connecting the element substrate 151 and the top plate 153, liquid flow paths (unshown) for the liquid to be ejected is formed. The confining spring 128 urges the top plate 153 toward the element substrate 151, by which the element substrate 151, the top plate 153 and the supporting member 120 are unified. When the top plate and the element substrate are connected by adhesive material with each other, the confining spring is not necessary. The supporting member 120 supports the element substrate 151 or the like, and the supporting member 120 is provided with print wiring substrate 123 for supplying electric signals to the element substrate 151 and contact pads 124 for connection with the main assembly of the apparatus for communication therebetween.

The liquid container 140 contains liquid to be supplied to the liquid ejecting head 200. On the outside of the liquid container 140 are provided a positioning portion 144 for positioning a connecting member for connection between the liquid container 140 and the liquid ejecting head 200, and a fixed shaft 145 for fixing the connecting member The liquid is supplied through a supply passage of the connecting member from the liquid supply paths 142, 143 of the liquid container 140 to the liquid supply paths 131, 132 of the liquid supply member 130, and is supplied to the common liquid chamber through the liquid supply passages 133, 129, 153*c*. In this embodiment, the liquid is supplied from the liquid container 140 to the liquid supply member 130 through two paths, but only one path may be provided.

The liquid container 140 may be refilled with the liquid after the liquid therein is used up. In order to permit this, the liquid container 140 is preferably provided with a liquid injection port. The liquid ejecting head 200 and the liquid container 140 may be integral or separable.

Figure 17:
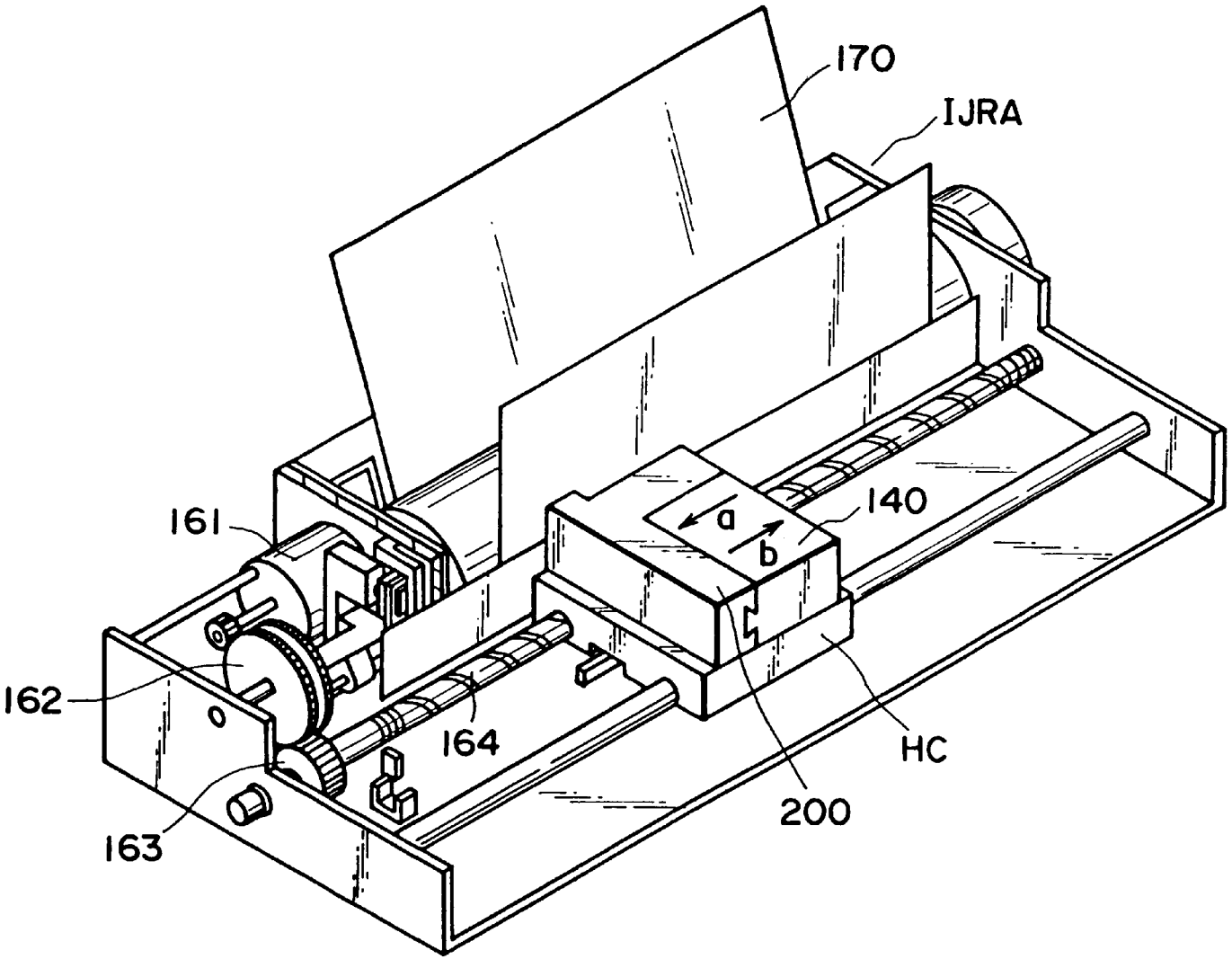
FIG. 17 is a schematic illustration of a liquid ejecting apparatus to which the present invention is applicable.

FIG. 17 shows a general arrangement of a liquid ejecting apparatus loaded with the liquid ejecting head described hereinbefore. In this embodiment, the description will be made as to an ink ejection recording apparatus IJRA using ink as the ejection liquid. The liquid ejecting apparatus has a carriage HC which is loaded with a head cartridge including a liquid container 140 for accommodating ink and a liquid ejecting head 200 which are detachable relative to each other, and the carriage reciprocates in a lateral direction (arrows an and b) of the recording material 170 for feeding the recording paper fed by the recording material feeding means. The liquid container and the liquid ejecting head are detachable from each other.

In FIG. 17, when a driving signal is supplied to the liquid ejecting means on the carriage HC from the unshown driving signal supply means, the recording liquid is ejected from the liquid ejecting head 200 to the recording material 170 in response to the signal.

In the liquid ejecting apparatus of this embodiment further includes a recording material feeding means, a motor 161 as a driving source for driving the carriage HC, gears 162, 163 for transmitting power to the carriage HC from the driving source, and a carriage shaft 164. With this recording device, the liquid is ejected to various recording materials, so that proper image is formed thereon.

Figure 18:
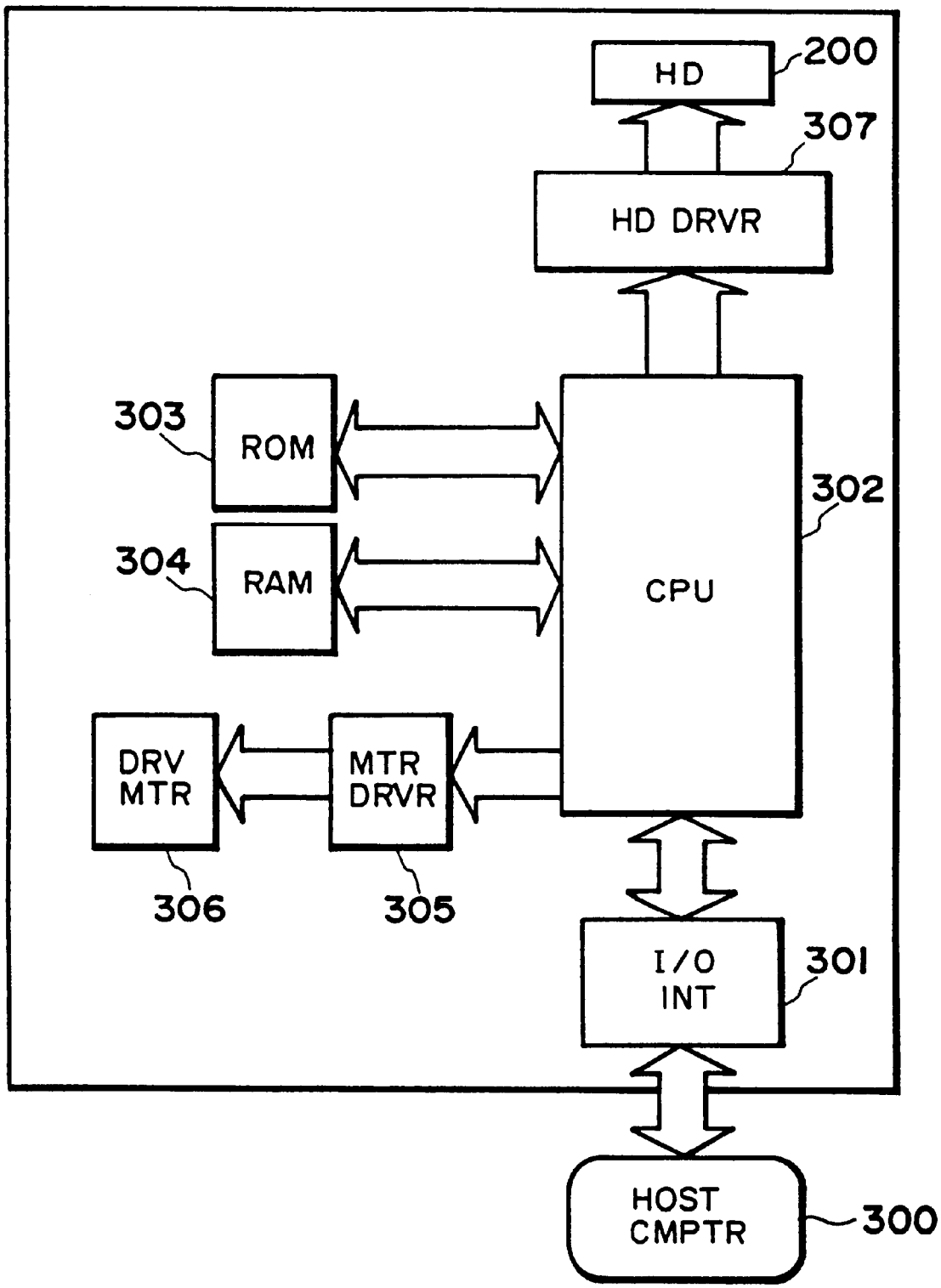
FIG. 18 is an apparatus block diagram of a liquid ejecting apparatus to which the present invention is applicable.

FIG. 18 is a block diagram of the entire apparatus for operating the ink ejection recording apparatus using the liquid ejecting head of the present invention The recording device receives the printing information as the control signal, from the host computer 300. The printing information is temporarily stored in the I/O interface 301, and simultaneously it is converted to data which can be processed in the recording device, and then inputted to a CPU302 functioning also as head driving signal supply means. On the basis of the control program kept in the ROM303, the CPU302 processes the data inputted to the CPU302, using a peripheral unit such as RAM304, and converts it to printing data (image data).

The CPU302 produces driving data for driving a driving motor 306 for moving the head 200 and the recording sheet in synchronism with image data to record the Image data on a proper portion of the recording sheet. The image data and motor driving data are transmitted to the head 200 and the driving motor 306 through the head driver 307 and the motor driver 305 to form the image by driving at controlled timing.

The recording material usable with the recording devices described above include various paper, OHP sheet, plastic resin material such as compact disk, ornament plate or the like, textile, metal material such as aluminum or copper, leather material such as cattle hide; pigskin or artificial leather, wood material such as wood, plywood, bamboo, ceramic material, such as tile, three-dimensional assembly such as sponge.

The recording apparatuses include a printer for printing on various paper, OHP sheet or the like, plastic resin material material, printing apparatus for printing on plastic resin material such as compact disk, a metal recording device for printing on metal, a leather recording device for printing on leather, a wood material printing apparatus for printing on wood material, a ceramic recording device for printing on ceramic material, a recording device for printing on a three dimensional material such as sponge, and textile printing apparatus for printing on textile, or the like.

The ejection liquid usable with the liquid ejecting apparatus, is easily selected by one skilled in the art on the basis of the recording material and the recording conditions.

The description will be made as to an example of an ink jet recording system for effecting recording on a recording material using the liquid ejecting head as a recording or printing head.

Figure 19:
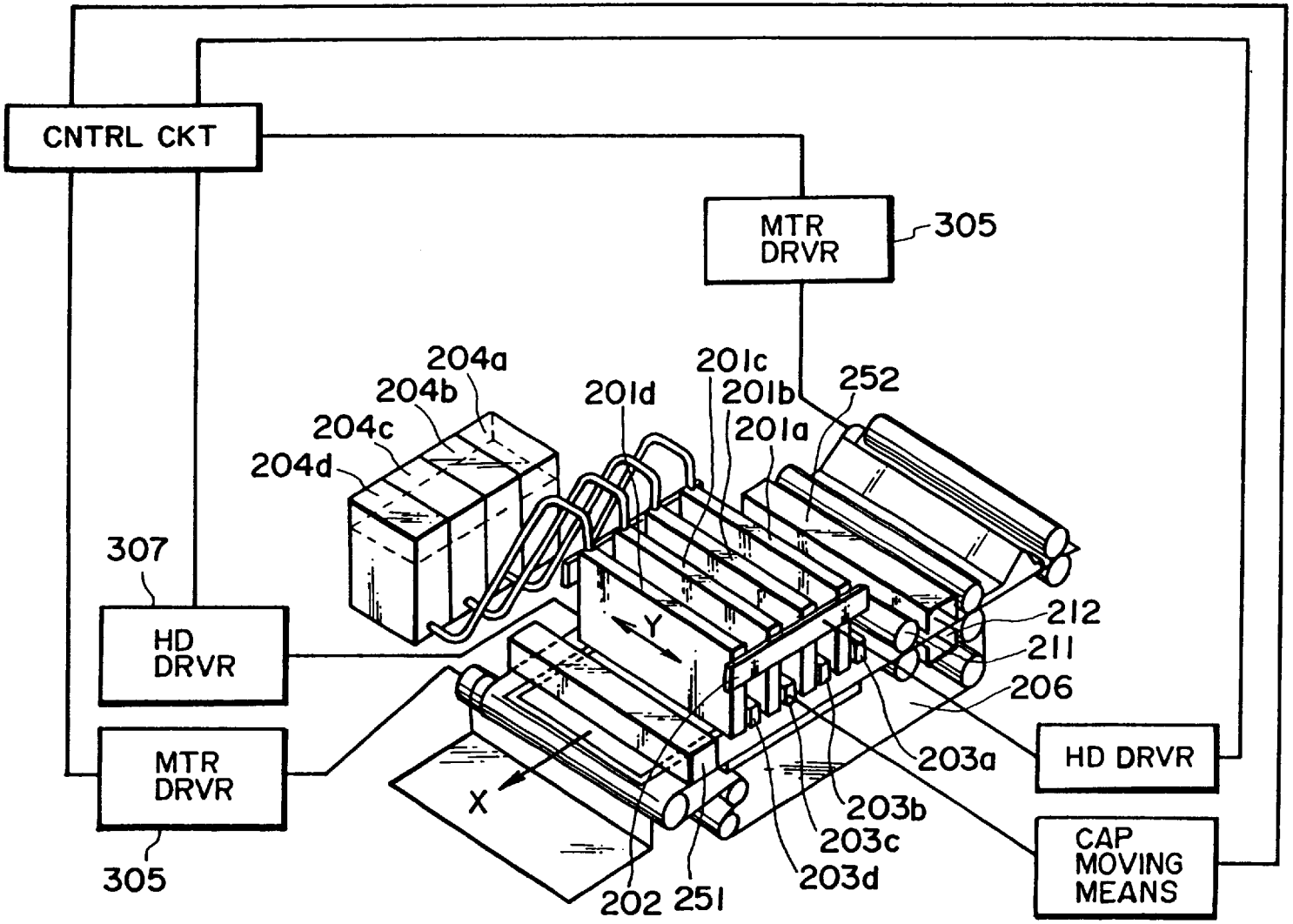
FIG. 19 shows a liquid ejection system to which the present invention is applicable.
Figure 20:
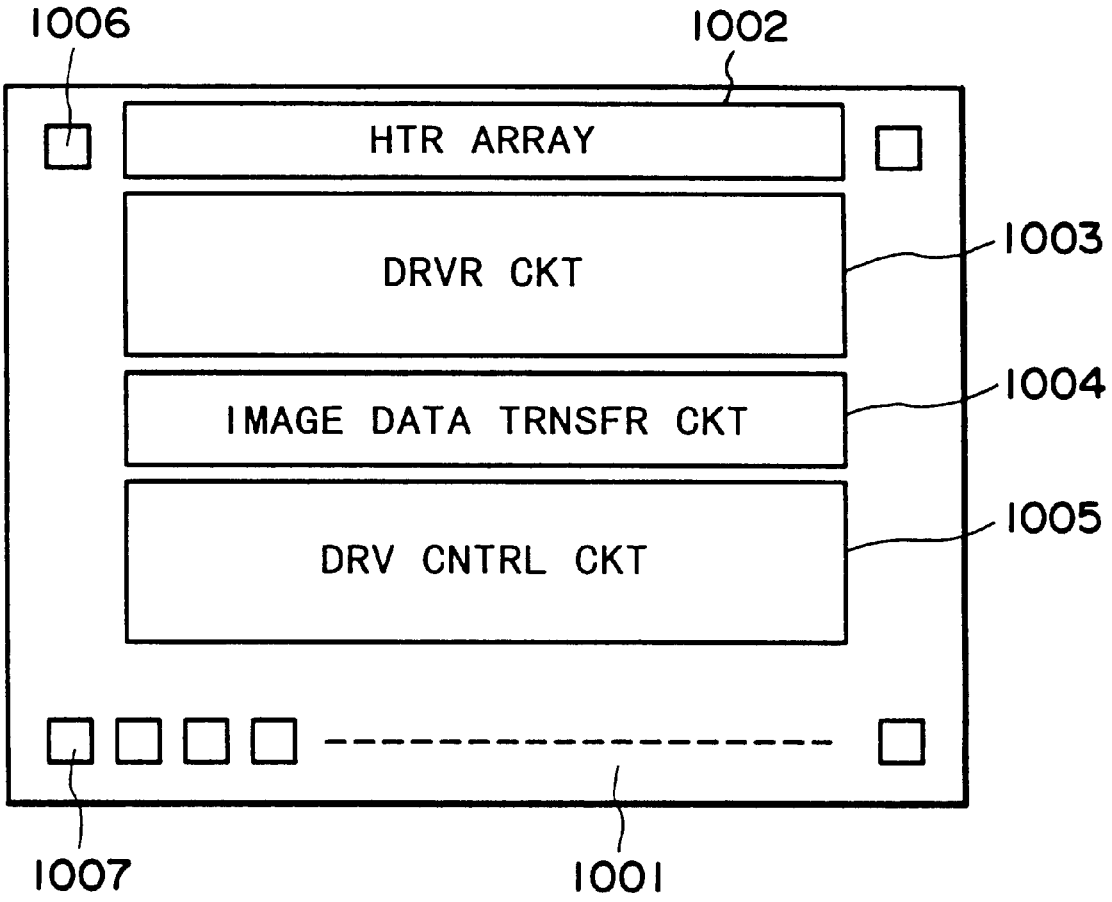
FIG. 20 PRIOR ART
FIG. 20 shows a circuit of an element substrate of a conventional head.

FIG. 19 is a schematic view illustrating an ink jet recording system using the liquid ejecting head of the present invention. The liquid ejecting head of this embodiment is a full line type head having ejection outlets arranged with 360 dpi over a length corresponding to a recordable width of the recording material. Four of such heads 201*a*–201*d* for yellow (Y), magenta (M), cyan (C) and black (Bk) are fixedly supported in parallel with each other in X direction with predetermined gaps between adjacent ones.

Signals are fed from head drivers 307 constituting the driving signal supply means to the heads 201*a*–201*d*, and the heads 201*a*–201*d* are driven in response to the signals. Four color inks (Y, M, C, Bk) are supplied as the ejection liquid from the ink container 204*a*–204*d* to the heads 201*a*–201*d*.

Below the heads 201*a*–201*d*, there are provided head caps 203*a*–203*d* having ink absorbing member such as sponge therein, and during non-recording, they cover the ejection outlets of the heads 201*a*–201*d* to maintain the heads 201*a*–201*d*.

Designated by reference numeral 206 is a conveyer belt constituting feeding means for feeding the recording material as described above. The conveyer belt 206 is extended along a predetermined path around various rollers, and is driven by a driving roller connected to a motor driver 305.

In this jet recording system, there are provided preprocessing device 251 and post processing device 252 for carrying out various processings. On the recording material before and after the recording operation, upstream and downstream of the recording material feeding path, respectively.

The post-process and the recording carries out different processing or treatment depending on the material of the recording object or ink material. For example, for the metal, plastic resin material, ceramic or the like, the pre-processing may be application of ultraviolet radiation and ozone to activate the surface, thus improving the deposition property of the ink. For the plastic resin material or the like which easily generates static electricity, and therefore, the dust is easily deposited thereon and may deteriorate the print. Therefore, the preprocess may use an ionizer apparatus to remove the static electricity of the recording material and to remove the dust When the textile is used as the recording material, alkaline substance, water-soluble substance, composite polymeric, water-soluble metallic salt, urea or thiourea may be applied from the standpoint of spread prevention, improvement in the fixing or the like. The pre-process is not limited to this, and may be the one for providing proper temperature of the recording material.

On the other hand, the post-process may be heat treatment, ultraviolet radiation projection or the like, for the recording material having received the ink to promote the fixing of the ink, or it may be the process for removing the processing material remaining as a result of pre-process and non-reaction.

In this example, the head 201*a*–201*d* has been described as a full-line head, but this is not limiting, and a small head may be moved in the lateral direction of the recording material.

As described in the foregoing the plurality of elements and/or the electric circuits for controlling the driving condition of the energy conversion elements are distributed to the first substrate and the second substrate depending on the their functions, so that liquid ejecting head can be downsized. Additionally, since the function is not concentrated on one substrate, the yield of the substrate is improved, and as a result, the manufacturing cost of the head can be lowered.

An external contact is provided on one of the first substrate and the second substrate, and opposing surfaces of the first substrate and the second substrate are provided with a connection electrode, so that electrical connection between the electric circuits or the elements can be established simultaneously with the coupling or fastening of the first substrate and the second substrate, while the connection with the outside can be effected in the similar manner as conventional manner.

By making the first substrate and the second substrate from silicon material, the element and the electric circuit can be produced using the semiconductor wafer processing technique, and the positional deviation due to the difference in the thermal-expansion between the first substrate and the second substrate can be prevented.

At least the second substrate may be provided with a temperature sensor, a limitation circuit for limiting or stopping driving of the heat generating resistor in accordance with an output of the temperature sensor, so that difference of the temperature propagation depending on the presence or absence of the ink in the head, and the driving of the heat generating resistor can be limited or stopped on the basis of result thereof. Thus, the third object can be accomplished. By manufacturing the temperature sensor and the limitation circuit using the semiconductor wafer processing technique, highly accurate detection of presence or absence of the ink is possible without cost increase The energy conversion elements generate bubbles in the liquid by application of thermal energy, and each of said liquid flow paths may be provided with a movable member disposed faced to the energy conversion element and having a free end at a downstream side with respect to liquid flow toward then ejection outlet. By doing so, the propagating direction of the pressure resulting from the generation of the bubble and the expanding direction of the bubble per se can be directed toward the downstream side by the movable member, so that ejection property such as the ejection efficiency, the ejection power or the ejection speed is improved.

While the invention has been described with reference to the structures disclosed herein, it is not confined to the details set forth and this application is intended to cover such modifications or changes as may come within the purposes of the improvements or the scope of the following claims.

What is claimed is:

1. A liquid ejection head comprising:

a plurality of ejection outlets for ejecting liquid;

a first substrate and a second substrate for constituting a plurality of liquid flow paths in fluid communication with said ejection outlets, respectively when combined with each other;

a plurality of energy conversion elements disposed in said liquid flow paths, respectively to convert electrical energy to ejection energy for the liquid in said liquid flow paths;

a first plurality of elements or electric circuits for controlling driving conditions of said energy conversion elements; and a second plurality of elements or electric circuits for controlling driving conditions of said energy conversion elements, said second plurality of elements or electric circuits having functions that are different than functions of said first plurality of elements or electric circuits, wherein said first plurality of elements or electric circuits is provided only on said first substrate, and said second plurality of elements or electric circuits is provided on said second substrate.

2. A liquid ejection head according to claim 1, further comprising:

an outer contact for electrical connection of said first plurality and second plurality of elements or electric circuits with outside on either one of said first substrate or second substrate, and a connection electrode for electrical connection of said first plurality and second plurality of elements or electric circuits on surfaces of said first substrate and second substrate that are opposed to each other, so that said first plurality and second plurality of elements or electric circuits are electrically connected by combining said first substrate and second substrate.

3. A liquid ejection head according to claim 1, wherein said first substrate and second substrate are made from silicon material, and said first plurality and second plurality of elements or electric circuits are formed on said first substrate and second substrate through semiconductor wafer processing technique.

4. A liquid ejection head according to claim 1, wherein said energy conversion elements generate bubbles in the liquid by application of thermal energy, and each of said liquid flow paths is provided with a movable member disposed faced to said energy conversion element and having a free and at a downstream side with respect to liquid flow toward said ejection outlet.

5. A liquid ejection head according to claim 1, wherein said energy conversion elements are heat generating resistors.

6. A liquid ejection head according to claim 5, further comprising, as said first or second plurality of elements or electric circuits, a driver for driving said heat generating resistors, a shift register for receiving serially image data and for outputting the data in parallel to said driver, a temperature sensor for sensing a temperature adjacent said heat generating resistors, a sensor driving circuit for driving said temperature sensor, and a control circuit for controlling a driving condition of said heat generating resistor in accordance with an output from said temperature sensor, wherein said heat generating resistor, said driver and said shift register are provided on said first substrate, said sensor driving circuit and said control circuit are provided on said second substrate, and said temperature sensor is provided on either one of said first substrate and second substrates.

7. A liquid ejection head according to claim 6, wherein the control of the driving condition for said heat generating resistors is effected by changing electric energy supply duration to said heat generating resistors or timing at which an applied pulse is applied.

8. A liquid ejection head according to claim 6, further comprising, as said first or second plurality of elements or electric circuits, a limitation circuit, on said second substrate, for limiting or stopping driving of said heat generating resistor on the basis of an output of said temperature sensor, and said temperature sensor is provided at least on said second substrate.

9. A liquid ejection head according to claim 8, further comprising a plurality of temperature sensors, each of said plurality of temperature sensors being disposed adjacent to a different heat generating resistor.

10. A liquid ejection head according to claim 8, wherein a plurality of temperature sensors is provided on said first substrate and said second substrate.

11. A liquid ejection head according to claim 5, wherein said first substrate is at least provided with said heat generating resistors, a driver for driving said heat generating resistors, a shift register for receiving serially image data and for outputting in parallel the data to said driver, a resistance sensor for measuring a resistance value of said heat generating resistor elements, and said second substrate is at least provided with a sensor driving circuit for driving said resistance sensor, and a control circuit for controlling a driving condition for said heat generating resistors.

12. A liquid ejection head according to claim 11, wherein the control of the driving condition for said heat generating resistors is effected by changing electric energy supply duration to said heat generating resistors or timing at which an applied pulse is applied.

13. A liquid ejection head according to claim 5, further comprising, as said first or second plurality of elements or electric circuits, a driver for driving said heat generating resistors, a shift register for receiving serially image data and for outputting in parallel the data to said driver, memory for storing head information, and a control circuit for controlling a driving condition for said heat generating resistors in accordance with head information stored in said memory, wherein said heat generating resistor, said driver and said shift register are provided on said first substrate, said control circuit is provided on said second substrate, and said memory is provided on either one of said first substrate or second substrates.

14. A liquid ejection head according to claim 13, wherein the control of the driving condition for said heat generating resistors is effected by changing electric energy supply duration to said heat generating resistors or timing at which an applied pulse is applied.

15. A liquid ejection head according to claim 13, wherein the head information includes data relating to a liquid ejection property which is a liquid ejection amount when said heat generating resistor elements are driven under a predetermined condition.

16. A liquid ejection head according to claim 13, wherein the head information includes data relating to the kind of liquid used.

17. A liquid ejection head according to claim 13, further comprising, as said first or second plurality of elements or electric circuits, a temperature sensor for sensing a temperature adjacent said heat generating resistor elements, a sensor driving circuit for driving said temperature sensor, and said control circuit for controlling a driving condition of said heat generating resistors in accordance with an output of said temperature sensor and said head information, wherein said sensor driving circuit is provided on said second substrate, and said temperature sensor is provided either on said first substrate or second substrate.

18. A liquid ejection head according to claim 17, wherein the head information includes a variation correcting value for correcting an output of said temperature sensor.

19. A liquid ejection head according to claim 17, further comprising, as said first or second plurality of elements or electric circuits, a limitation circuit, on said second substrate, for limiting and stopping driving of said heat generating resistor on the basis of an output of said temperature sensor, and said temperature sensor is provided at least on said second substrate.

20. A liquid ejection head according to claim 13, further comprising, as said first or second plurality of elements or electric circuits, a resistance sensor for sensing a resistance value of said heat generating resistor element, a sensor driving circuit for driving said resistance sensor, wherein said control circuit controls a driving condition of said heat generating resistors in accordance with resistance value data outputted from said resistance sensor and said head information, said resistance sensor is provided on said first substrate, and said sensor driving circuit is provided on said second substrate.

21. A liquid ejection head according to claim 20, wherein the head information includes resistance value data outputted from said resistance sensor or a coded rank value classified from the resistance value data.

22. A liquid ejection head according to claim 1, wherein said first plurality of elements or electric circuits is electrically connected directly or indirectly to said energy conversion elements on an individual or group basis, a group being more than one but less than all of said energy conversion elements;

said first plurality of elements or electric circuits is provided on on said first substrate along with said energy conversion elements; and said second plurality of elements or electric circuits is provided on said second substrate.

23. A liquid ejection head according to claim 22, wherein said first plurality of elements or electric circuits comprises drivers for driving said energy conversion elements.

24. A liquid ejection head according to claim 22, wherein said first plurality of elements or electric circuits comprises a shift register for receiving image data serially and outputting it in parallel.

25. A liquid ejection head according to claim 22, wherein said first plurality of elements or electric circuits comprises a latching circuit for storing data outputted in parallel from a shift register.

26. A liquid ejection head according to claim 1, wherein said first substrate is at least provided with said energy conversion elements, a driver for driving said energy conversion elements, a shift register for receiving serially image data and for outputting in parallel the data to said driver, a temperature sensor for sensing a temperature of said first substrate, a heater for heating said first substrate, and a driver for driving said heater, and wherein said second substrate is at least provided with a sensor driving circuit for driving said temperature sensor, a heater control circuit for controlling a driving condition of said heater at such a temperature of said first substrate as to permit stable liquid ejection, on the basis of the output of the temperature sensor.

27. A liquid ejection head according to claim 26, further comprising a temperature sensor, on said second substrate, for sensing a temperature of said second substrate, and a limitation circuit for limiting or stopping driving of said energy conversion elements on the basis of an output of the temperature sensors provided on said first and second substrate.

28. A head cartridge including a liquid ejecting head for ejecting liquid and liquid container for containing liquid to be supplied to the liquid ejecting head, said liquid ejecting head comprising:

a plurality of ejection outlets for ejecting liquid;

a first substrate and a second substrate for constituting, when combined with each other, a plurality of liquid flow paths in fluid communication with said ejection outlets;

a plurality of energy conversion elements, each disposed in one of said liquid flow paths, for converting electrical energy to ejection energy for ejecting the liquid in said liquid flow path;

a first plurality of elements or electric circuits for controlling driving conditions of said energy conversion elements; and a second plurality of elements or electric circuits for controlling driving conditions of said energy conversion elements, said second plurality of elements or electric circuits having functions that are different than functions of said first plurality of elements or electric circuits, wherein said first plurality of elements or electric circuits is provided only on said first substrate, and said second plurality of elements or electric circuits is provided on said second substrate.

29. A head cartridge according to claim 28, wherein said liquid ejecting head and said liquid container are detachably mountable relative to each other.

30. A liquid ejection recording device including a liquid ejecting head for ejecting liquid, a liquid container for containing liquid to be supplied to the liquid ejecting head, said liquid ejection recording device comprising:

driving signal supply means for supplying a driving signal for ejecting the liquid from said liquid ejecting head;

a plurality of ejection outlets for ejecting liquid from said liquid ejecting head;

a first substrate and a second substrate for constituting, when combined with each other, a plurality of liquid flow paths in fluid communication with said ejection outlets;

a plurality of energy conversion elements, each disposed in one of said liquid flow paths, for converting electrical energy to ejection energy for ejecting the liquid in said liquid flow path;

a first plurality of elements or electric circuits for controlling driving conditions of said energy conversion elements; and a second plurality of elements or electric circuits for controlling driving conditions of said energy conversion elements, said second plurality of elements or electric circuits having functions that are different than functions of said first plurality of elements or electric circuits, wherein said first plurality of elements or electric circuits is provided only on said first substrate, and said second plurality of elements or electric circuits is provided on said second substrate.

* * * * *

UNITED STATES PATENT AND TRADEMARK OFFICE

CERTIFICATE OF CORRECTION

PATENT NO. : 6,293,655 B1
DATED : September 25, 2001
INVENTOR(S) : Yoshiyuki Imanaka et al.

It is certified that error appears in the above-identified patent and that said Letters Patent is hereby corrected as shown below:

Drawings,
Sheet 19, FIG. 19, "202" should be deleted; and "211" should be deleted.

Column 1,
Line 20, "image having" should read -- images making --;
Line 22, "having" should read -- making --;
Line 37, "or" should read -- on a --;
Line 40, "machine." should read -- machines. --; and
Line 42, "machine" should be deleted.

Column 2,
Line 3, "outside" should read -- outside. --;
Line 16, "inventors" should read -- inventors' --; and
Line 48, "thermal-expansion" should read -- thermal expansion --.

Column 3,
Line 4, "are" should read -- is --;
Line 13, "as are" should read -- as being --;
Line 19, "as are" should read -- as being --;
Line 28, "as are" should read -- as being --;
Line 44, that" should read -- that the --;
Line 47, "of" should read -- of the --; and
Line 52, "without" should read -- without a --.

Column 4,
Line 1, "(or" should read -- (or a --; and
Line 43, "an" should read -- on --.

Column 5,
Line 36, "corresponding" should read -- corresponding to --.

Column 7,
Line 34, "supply" should read -- supplying --.

Column 9,
Line 26, "thermal-expansion" should read -- thermal expansion --.

UNITED STATES PATENT AND TRADEMARK OFFICE

CERTIFICATE OF CORRECTION

PATENT NO. : 6,293,655 B1
DATED : September 25, 2001
INVENTOR(S) : Yoshiyuki Imanaka et al.

It is certified that error appears in the above-identified patent and that said Letters Patent is hereby corrected as shown below:

Column 12,
Line 9, "(detail" should read -- (details --; and
Line 59, "is" should read -- are --.

Column 13,
Line 1, "involves" should read -- involve --; and
Line 7, "with," should read -- with --.

Column 14,
Line 15, "that" (second occurrence) should read -- that a --;
Line 17, "that" (second occurrence) should read -- that a --; and
Line 23, "a" should be deleted; and "circuits" should read -- circuits, --.

Column 15,
Line 9, "element 402" should read -- elements 402 --;
Line 12, "pad 414," should read -- pads 414 --;
Line 24, "heater 402" should read -- heater 412 --;
Line 30, "inventions" should read -- invention, --;
Line 48, "resistor 402" should read -- resistor 412 --;
Line 51, "this this" should read -- this --; and
Line 67, "In" should read -- in --.

Column 16,
Line 11, "heat heat" should read -- heat --;
Line 33, "substrates." should read -- substrate. --;
Line 60, "a" should read -- an --; and
Line 66, "is" should read -- are --.

Column 17,
Line 16, "member" should read -- member. --;
Line 39, "an" should read -- a --;
Line 48, "In the" should read -- The --; and
Line 57, "invention" should read -- invention. --.

Column 18,
Line 3, "Image" should read -- image --;
Line 18, "material material," should read -- material, a --;
Line 48, "having" should read -- having an --; and
Line 57, "prepro-" should read -- pre-pro --.

UNITED STATES PATENT AND TRADEMARK OFFICE

CERTIFICATE OF CORRECTION

PATENT NO. : 6,293,655 B1
DATED : September 25, 2001
INVENTOR(S) : Yoshiyuki Imanaka et al.

It is certified that error appears in the above-identified patent and that said Letters Patent is hereby corrected as shown below:

Column 19,
Line 5, "preprocess" should read -- pre-process --;
Line 7, "dust" should read -- dust. --;
Line 20, "head 201*a*-201*d* has" should read -- heads 201*a*-201*d* have --;
Line 21, "a full-line head" should read -- full-line heads --;
Line 28, "head" should read -- heads --;
Line 45, "thermal-expansion" should read -- thermal expansion --;
Line 50, "that" should read -- that a --; and
Line 64, "then" should read -- the --.

Column 20,
Line 58, "and" should read -- end --.

Column 22,
Line 53, "on on" should read -- on --.

Signed and Sealed this

Twenty-first Day of May, 2002

*Attest:*

*Attesting Officer*

JAMES E. ROGAN
*Director of the United States Patent and Trademark Office*